US010208592B2

(12) United States Patent
Rimmington

(10) Patent No.: US 10,208,592 B2
(45) Date of Patent: Feb. 19, 2019

(54) LONGWALL OPTIMIZATION CONTROL

(71) Applicant: Joy MM Delaware, Inc., Wilmington, DE (US)

(72) Inventor: Gareth Rimmington, South Yorks (GB)

(73) Assignee: Joy Global Underground Mining LLC, Warrendale, PA (US)

( * ) Notice: Subject to any disclaimer, the term of this patent is extended or adjusted under 35 U.S.C. 154(b) by 509 days.

(21) Appl. No.: 14/956,638

(22) Filed: Dec. 2, 2015

(65) Prior Publication Data

US 2017/0159431 A1 Jun. 8, 2017

(51) Int. Cl.

| | |
|---|---|
| ***E21C 35/14*** | (2006.01) |
| ***E21C 27/02*** | (2006.01) |
| ***E21C 25/06*** | (2006.01) |
| ***E21C 35/24*** | (2006.01) |
| ***E21D 23/00*** | (2006.01) |
| ***E21F 13/06*** | (2006.01) |
| ***E21C 27/10*** | (2006.01) |
| ***E21D 23/04*** | (2006.01) |
| ***E21D 23/06*** | (2006.01) |

(52) U.S. Cl.

CPC ..... *E21C 27/02* (2013.01); *E21C 25/06* (2013.01); *E21C 27/10* (2013.01); *E21C 35/14* (2013.01); *E21C 35/24* (2013.01); *E21D 23/0004* (2013.01); *E21D 23/0065* (2013.01); *E21D 23/0454* (2013.01); *E21D 23/066* (2013.01); *E21F 13/06* (2013.01)

(58) Field of Classification Search

CPC ..... E21D 23/18; E21C 35/14; E21C 41/16

USPC ..... 299/1.05–1.9

See application file for complete search history.

(56) References Cited

U.S. PATENT DOCUMENTS

| | | | |
|---|---|---|---|
| 3,146,909 | A | 9/1964 | Sawada |
| 4,212,382 | A | 7/1980 | Williams |
| 5,575,583 | A | 11/1996 | Grembowicz et al. |
| 6,193,050 | B1 | 2/2001 | Svejkovsky et al. |
| 6,209,711 | B1 | 4/2001 | Koopmann et al. |

(Continued)

FOREIGN PATENT DOCUMENTS

| | | | |
|---|---|---|---|
| CN | 204369061 | U | 6/2015 |
| CN | 105217271 | A | 1/2016 |

(Continued)

OTHER PUBLICATIONS

Search Report from the Patent Office of the Republic of Poland for Application No. P-419660 dated Apr. 10, 2017 (6 pages).

(Continued)

*Primary Examiner* — Sunil Singh

(74) *Attorney, Agent, or Firm* — Michael Best & Friedrich LLP

(57) ABSTRACT

A method of controlling a longwall mining system, the longwall mining system including a longwall shearer, a conveyor, and a plurality of roof supports, such that the method includes creating, by a controller, a load profile of the conveyor representing a distribution of mineral along a length of the conveyor, calculating, by the controller, a desired change in the load profile based on the load profile of the conveyor, and controlling, by the controller, the longwall mining system to adjust the distribution of mineral on the conveyor based on the desired change in load profile.

23 Claims, 22 Drawing Sheets

(56) References Cited

U.S. PATENT DOCUMENTS

| | | | | |
|---|---|---|---|---|
| 6,739,446 | B2 | 5/2004 | Niemela et al. | |
| 6,848,568 | B1 | 2/2005 | Nibler | |
| 8,347,709 | B2 | 1/2013 | Kormann | |
| 8,398,006 | B2 | 3/2013 | Gitschel | |
| 8,672,414 | B2 * | 3/2014 | Junker | E21D 23/12 299/1.7 |
| 8,708,421 | B2 * | 4/2014 | Junker | E21C 35/24 299/1.7 |
| 9,016,458 | B2 | 4/2015 | Bogle | |
| 9,440,797 | B1 | 9/2016 | Rimmington | |
| 2012/0098325 | A1 * | 4/2012 | Junker | E21C 35/24 299/1.7 |
| 2015/0061350 | A1 * | 3/2015 | Paterson | E21C 25/06 299/1.4 |

FOREIGN PATENT DOCUMENTS

| | | | |
|---|---|---|---|
| DE | 4021302 | A1 | 1/1992 |
| DE | 4414434 | A1 | 11/1995 |
| EP | 0811427 | A2 | 12/1997 |
| GB | 2092207 | A * | 8/1982 |
| GB | 2493102 | A | 1/2013 |
| GB | 2541266 | A | 2/2017 |
| GB | 2541532 | A | 2/2017 |
| JP | S61287615 | A | 12/1986 |
| JP | S62265514 | A | 11/1987 |
| JP | 2005282265 | A | 10/2005 |
| KR | 101330554 | B1 | 11/2013 |
| RU | 2566324 | C1 | 10/2015 |
| WO | WO 2010031501 | A1 * | 3/2010 |
| WO | WO 2010149315 | A2 * | 12/2010 |
| WO | 2011023853 | A2 | 3/2011 |
| WO | WO 2012031610 | A1 * | 3/2012 |
| WO | 2015034497 | A1 | 3/2015 |

OTHER PUBLICATIONS

Office Action from the State Intellectual Property Office of the People's Republic of China for Application No. 201621314677.3 dated May 5, 2017 (3 pages).

Search Report from the United Kingdom Intellectual Property Office for Application No. GB1620001.6 dated May 16, 2017 (7 pages).

* cited by examiner

500

LONGWALL OPTIMIZATION CONTROL

FIELD OF THE INVENTION

The present invention relates to conveyor systems, and particularly to longwall mining systems.

BACKGROUND

Longwall mining systems generally extract ore through sharing mineral off of a mineral face onto a conveyor. The extracted mineral is carried away from the mineral face by the conveyor for further processing. Existing systems have inefficiencies. For example, the conveyor typically does not have a speed that is adjusted during mining. Accordingly the conveyor may operate at higher speeds and use more power than necessary even where little material is on the conveyor. Further, if the conveyor is moving too slowly, extracted ore cannot be moved

SUMMARY

In one embodiment, the invention provides a method of controlling a longwall mining system where the longwall mining system includes a longwall shearer, a conveyor, and a plurality of roof supports. The method includes creating, by a controller, a load profile of the conveyor representing a distribution of mineral along a length of the conveyor, calculating, by the controller, a desired change in the load profile based on the load profile of the conveyor, and controlling, by the controller, the longwall mining system to adjust the distribution of mineral on the conveyor based on the desired change in load profile.

In another embodiment the invention provides a longwall mining system including a shearer, a plurality of roof supports, and a conveyor having a distribution of mineral along a length of the conveyor where the distribution of mineral represented by a load profile. The longwall mining system further includes a plurality of motors for driving the shearer, the conveyor, and the roof supports, and a controller configured to control the plurality of motors, wherein the controller controls the plurality of motors based on a desired change in the load profile.

In another embodiment the invention provides a method of controlling a longwall mining system where the longwall mining system has a plurality of controllable components including a longwall shearer, a conveyor, and a plurality of roof supports. The method includes determining, by the controller, a desired change in a conveyor characteristic, controlling, by the controller, the controllable components of the longwall mining system to achieve the desired change in conveyor characteristic, and controlling the controllable components by executing a plurality of commands to adjust at least one of the controllable components, the plurality of commands being executed according to a hierarchy.

In another embodiment the invention provides a longwall mining system including a plurality of controllable components including a conveyor, a shearer, and a plurality of roof supports, a conveyor characteristic having a desired change in conveyor characteristic, and a controller electrically coupled to the controllable components, where the controller is configured to execute a plurality of commands to adjust the operation of at least one of the controllable components to achieve the desired change in conveyor characteristic. The longwall mining system further includes a hierarchy of commands, such that the controller is configured to execute the plurality of commands according to the hierarchy.

Other aspects of the invention will become apparent by consideration of the detailed description and accompanying drawings.

DETAILED DESCRIPTION

Figure 1:
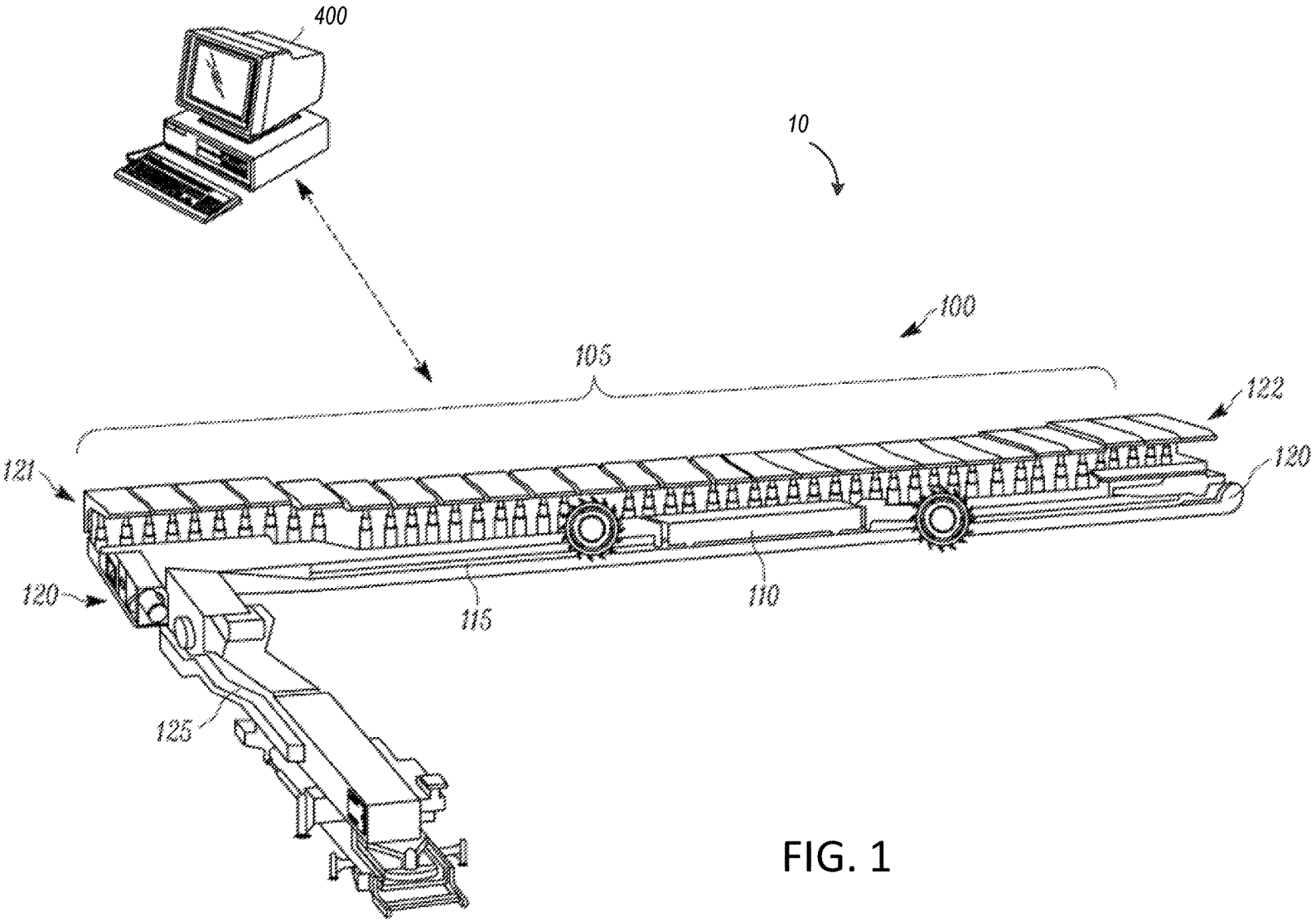
FIG. 1 is a schematic diagram of an extraction system including a longwall mining system and an optimization control system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it would be noted that a plurality of hardware and software based devices, as well as a plurality of different structural components, may be utilized to implement the invention. Furthermore, and as described in subsequent paragraphs, the specific mechanical configurations illustrated in the drawings are intended to exemplify embodiments of the invention. However, other alternative mechanical configurations are possible. For example, "controllers" and "modules" described in the specification can include standard processing components, such as one or more processors, one or more computer-readable medium modules, one or more input/output interfaces, and various connections (e.g., a system bus) connecting the components. In some instances, the controllers and modules may be implemented as one or more of general purpose processors, digital signal processors DSPs), application specific integrated circuits (ASICs), and field programmable gate arrays (FPGAs) that execute instructions or otherwise implement their functions described herein.

FIG. 1 illustrates an extraction system 10. The extraction system 10 includes a longwall mining system 100 and an optimization control system 400. The extraction system 10 is configured to extract a product from a mine in an efficient manner. The longwall mining system 100 physically extracts minerals from an underground mine, while the optimization control system 400 monitors and controls the operation of the longwall mining system 100 to ensure that extraction of minerals remains efficient.

The longwall mining system 100 excavates coal from underground mines through the use of a series of controllable components such as automated electro-hydraulic roof supports (i.e., powered roof supports), a coal shearing machine (i.e., a longwall shearer), and an armored face conveyor (i.e., an AFC or conveyor). The longwall mining system 100 could also be used to extract other ores or minerals such as, for example, Trona. The longwall mining system 100 physically extracts coal, or another mineral, from an underground mine. The longwall mining system 100 could alternatively be used to physically extract coal, or another mineral, from a seam exposed above-ground (e.g., a surface mine). Longwall mining begins with identifying a coal seam to be mined, then "blocking out" the seam into coal panels by excavating roadways around the perimeter of each panel. During excavation of the seam (i.e., extraction of coal), select pillars of coal can be left unexcavated between adjacent coal panels to assist in supporting the overlying geological strata. The coal panels are excavated by the longwall mining system 100 shearing coal from to the coal face.

The optimization control system 400 monitors various conveyor characteristics and adjusts the operation of longwall mining system 100 based on these characteristics in order to improve efficiency of coal extraction and the lifetime of the longwall mining system 100. For example, the optimization control system 400 monitors the amount of coal or minerals being extracted and the motor torque of the system to find a balance between extracting coal efficiently without over burdening the motor. This ensures that the lifetime of the motor is improved and power consumption is reduced while continuing to extract minerals at a sufficient rate.

FIG. 1 illustrates the longwall mining system 100 including roof supports 105 and a longwall shearer 110. The roof supports 105 are interconnected parallel to the coal face (not shown) by electrical and hydraulic connections. Further, the roof supports 105 shield the shearer 110 from the overlying geological strata. The number of roof supports 105 used in the mining system 100 depends on the width of the coal face being mined since the roof supports 105 are intended to protect the full width of the coal face from the strata. The shearer 110 is propagated along the line of the coal face by an armored face conveyor (hereinafter "conveyor" 115), which has a dedicated rack bar for the shearer 110 running parallel to the coal face 303 between the face itself and the roof supports 105. The conveyor 115 also includes a portion that runs parallel to the rack bar, such that excavated coal can fall onto the conveyor 115 to be transported away from the face. The conveyor 115 and the rack bar are driven by conveyor drives 120 located at a maingate 121 and a tailgate 122, which are at distal ends of the conveyor 115. The conveyor drives 120 allow the conveyor 115 to continuously transport coal toward the maingate 121, and allow the shearer 110 to be hauled along the rack bar of the conveyor 115 bi-directionally across the coal face. Note that depending on the specific mine layout, the layout of the longwall mining system 100 can be different than described above, for example, the maingate 121 can be on the right distal end of the conveyor 115 and the tailgate 122 can be on the left distal end of the conveyor 115.

The system 100 also includes a beam stage loader (BSL) 125 arranged perpendicularly at the maingate end of the conveyor 115. When the won coal hauled by the conveyor 115 reaches the maingate 121, it is routed through a 90° turn onto the BSL 125. In some instances, the BSL 125 interfaces with the conveyor 115 at an oblique angle (e.g., a non-right angle). The BSL 125 then prepares and loads the coal onto a maingate conveyor (not shown), which transports the coal to the surface. The coal is prepared to be loaded by a crusher (or sizer), which breaks down the coal to improve loading onto the maingate conveyor. Similar to the conveyor of the conveyor 115, the BSL's 125 conveyor is driven by a BSL drive.

Figure 2:
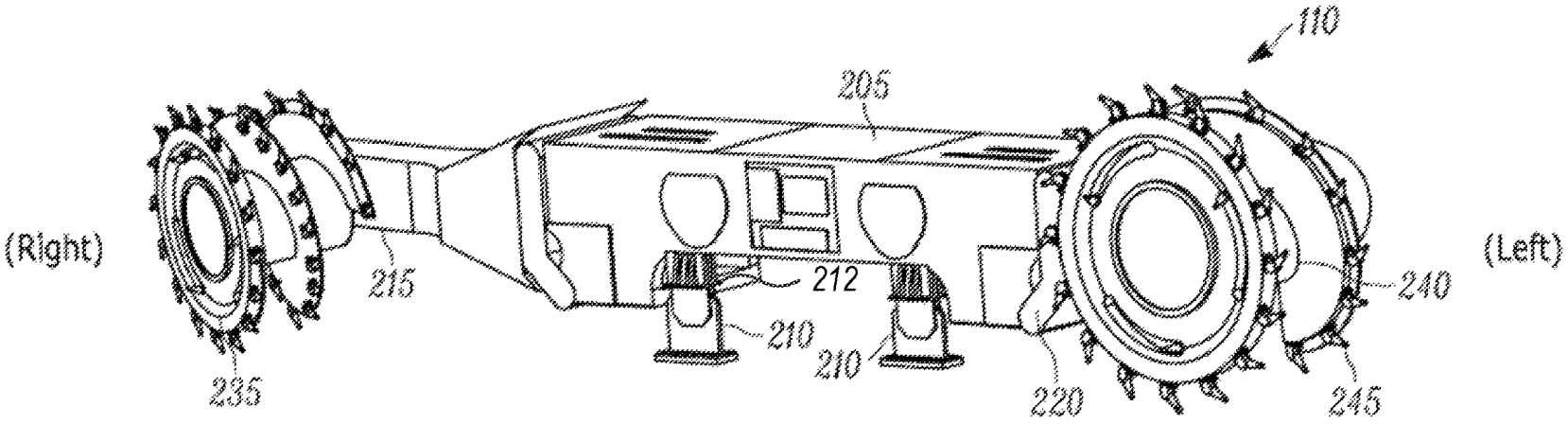
FIG. 2 is a perspective view of a longwall shearer of the longwall mining system of FIG. 1.

FIG. 2 illustrates the shearer 110. The shearer 110 has an elongated central housing 205 that stores the operating controls for the shearer 110. Extending below the housing 205 are skid shoes 210 and trapping shoes 212. The skid shoes 210 support the shearer 110 on the face side of the conveyor 115 (e.g., the side nearest to the coal face) and the trapping shoes 212 support the shearer 110 on the goaf side of the conveyor 115. In particular, the trapping shoes 212 and haulage sprockets engage the rack bar of the conveyor 115 allowing the shearer 110 to be propelled along the conveyor 115 and coal face. Extending laterally from the housing 205 are left and right ranging arms 215 and 220, respectively, which are raised and lowered by hydraulic cylinders, attached to the under-side of the ranging arms 215, 220 and body 205. On the distal end of the right ranging arm 215 (with respect to the housing 205) is a right cutter drum 235, and on the distal end of the left ranging arm 220 is a left cutter drum 240. Each cutter drum 235, 240 is driven by an electric motor via the gear train within the ranging arm 215, 220. Each of the cutter drums 235, 240 has a plurality of mining bits 245 (e.g., cutting picks) that abrade the coal face as the cutter drums 235, 240 are rotated, thereby cutting away the coal. The mining bits 245 are also accompanied by spray nozzles that spray fluid during the mining process in order to disperse noxious and/or combustible gases that develop at the excavation site, suppress dust, and enhance cooling.

Figure 3:
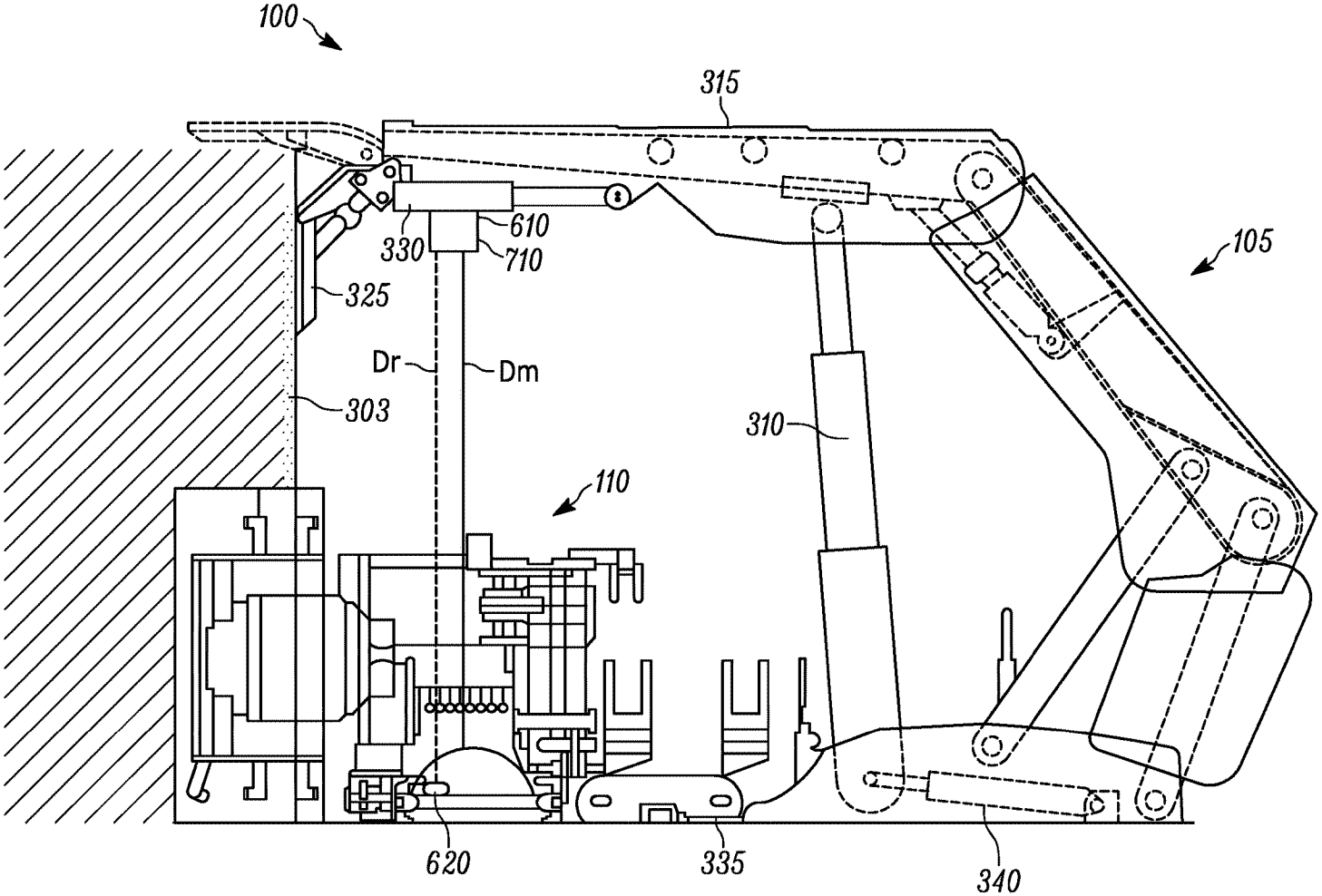
FIG. 3 is a side view of the longwall mining system of FIG. 1.
Figure 4:
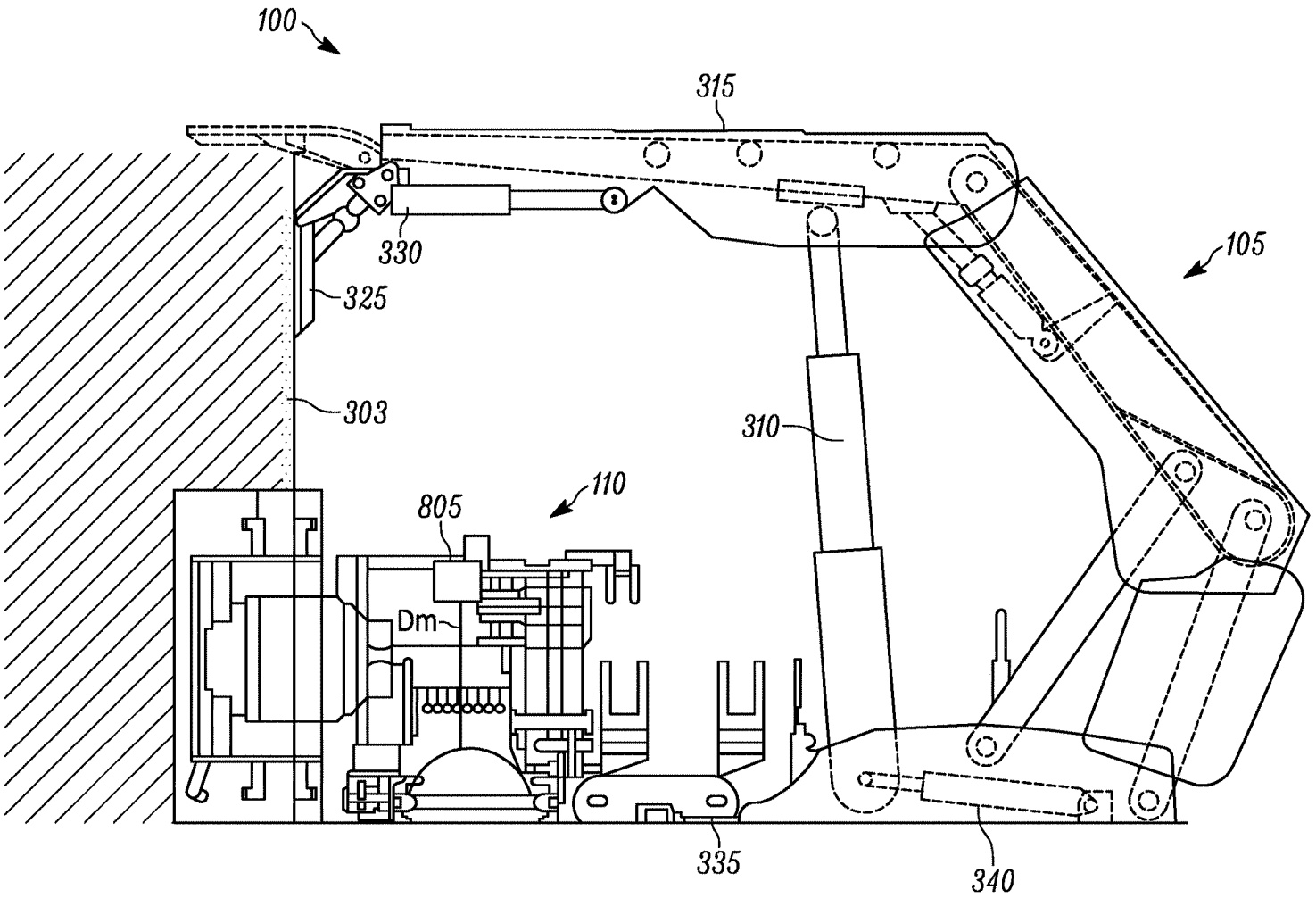
FIG. 4 is a side view of the longwall mining system of FIG. 1.
Figure 5:
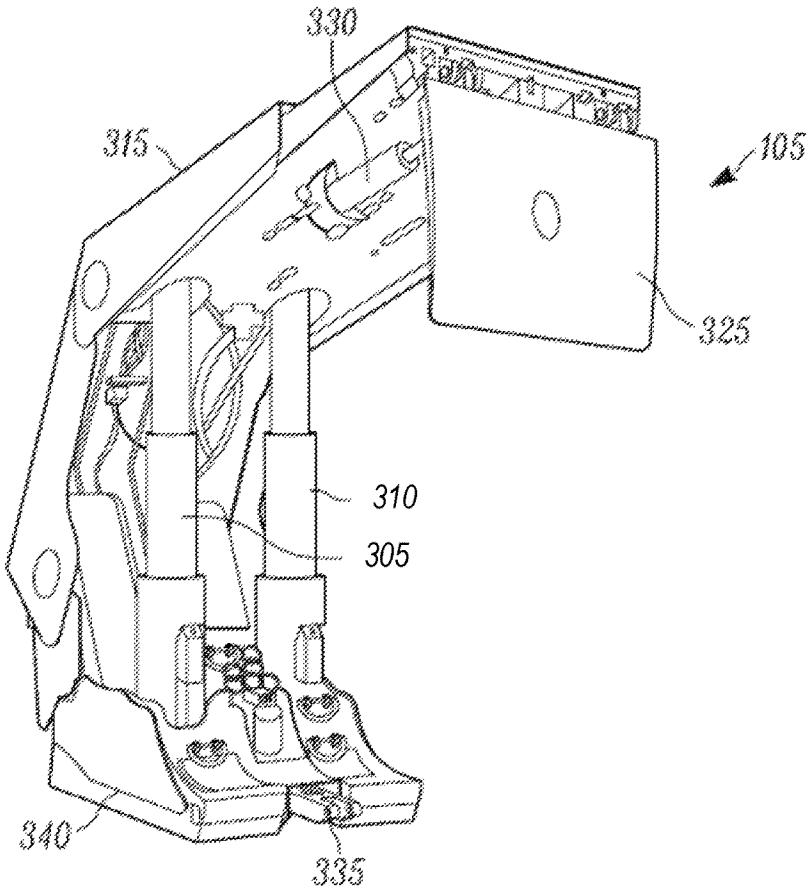
FIG. 5 is a perspective view of a power roof support of the longwall mining system of FIG. 1.

FIGS. 3 and 4 illustrate the longwall mining system 100 as viewed along the line of a coal face 303. The roof support 105 is shown shielding the shearer 110 from the strata above by an overhanging canopy 315 of the roof support 105. The canopy 315 is vertically displaced (i.e., moved toward and away from the strata) by hydraulic legs 305, 310 (see FIG. 5). The left and right hydraulic legs 305, 310 contain pressurized fluid to support the canopy 315. The canopy 315 thereby exerts a range of upward forces on the geological strata by applying different pressures to the hydraulic legs 305, 310. Mounted to the face end of the canopy 315 is a deflector or sprag 325 which is shown in a face-supporting position. However, the sprag 325 can also be fully extended, as shown in ghost, by a sprag ram 330 (FIG. 5). An advance ram 335 attached to a base 340 allows the roof support 105 to be advanced toward the coal face 303 as the layers of coal are sheared away to support the newly exposed strata. The advance ram 335 also allows the roof support 105 to push the conveyor 115 forward, toward the coal face 303. As the shearer 110 travels the width of the coal face 303 removing a layer of coal (e.g., a web of coal), the roof supports 105 automatically advance to support the roof of the newly exposed section of strata. The conveyor 115 is then advanced by the roof supports 105 toward the coal face 303 by a distance equal to the depth of the coal layer previously removed by the shearer 110. Advancing the conveyor 115 toward the coal face 303 in such a manner allows the shearer 110 to engage with the coal face 303 and continue shearing coal away from the coal face 303. The act of advancing the conveyor 115 toward the coal face 303 is referred to as "snaking" or "conveyor advance."

In some circumstances it may be desirable to delay the advancement of the conveyor 115 towards the coal face 303. This is referred to as a snake delay. During a snake delay the roof supports 105 continue to advance sequentially as the shearer 110 passes and the conveyor 115 continues to transport mineral toward the maingate 121. However, the conveyor 115 is not pushed toward the coal face 303 by the advance ram 335 of the roof supports 105 immediately after the shearer 110 passes by. Rather, the advance of the conveyor 115 is delayed (e.g., until the shearer 110 reaches an end of the coal face or completes or completes a shearer pass). One situation where it may be desirable to initiate a snake delay is when the conveyor 115 is overloaded with mineral. As the conveyor 115 is advanced toward the coal face 303, additional coal falls onto the conveyor 115. If the conveyor 115 is overloaded, it may be desirable to initiate a snake delay until a later time when the conveyor 115 is not overloaded. For example, the conveyor 115 tends to be carrying less mineral when the shearer 110 reaches the end of the coal face 303 and is in the process of changing directions. At this time, the snake delay can be removed such that the advance rams 335 of the roof supports 105 will begin to advance the conveyor 115 toward the coal face 303.

Figure 6:
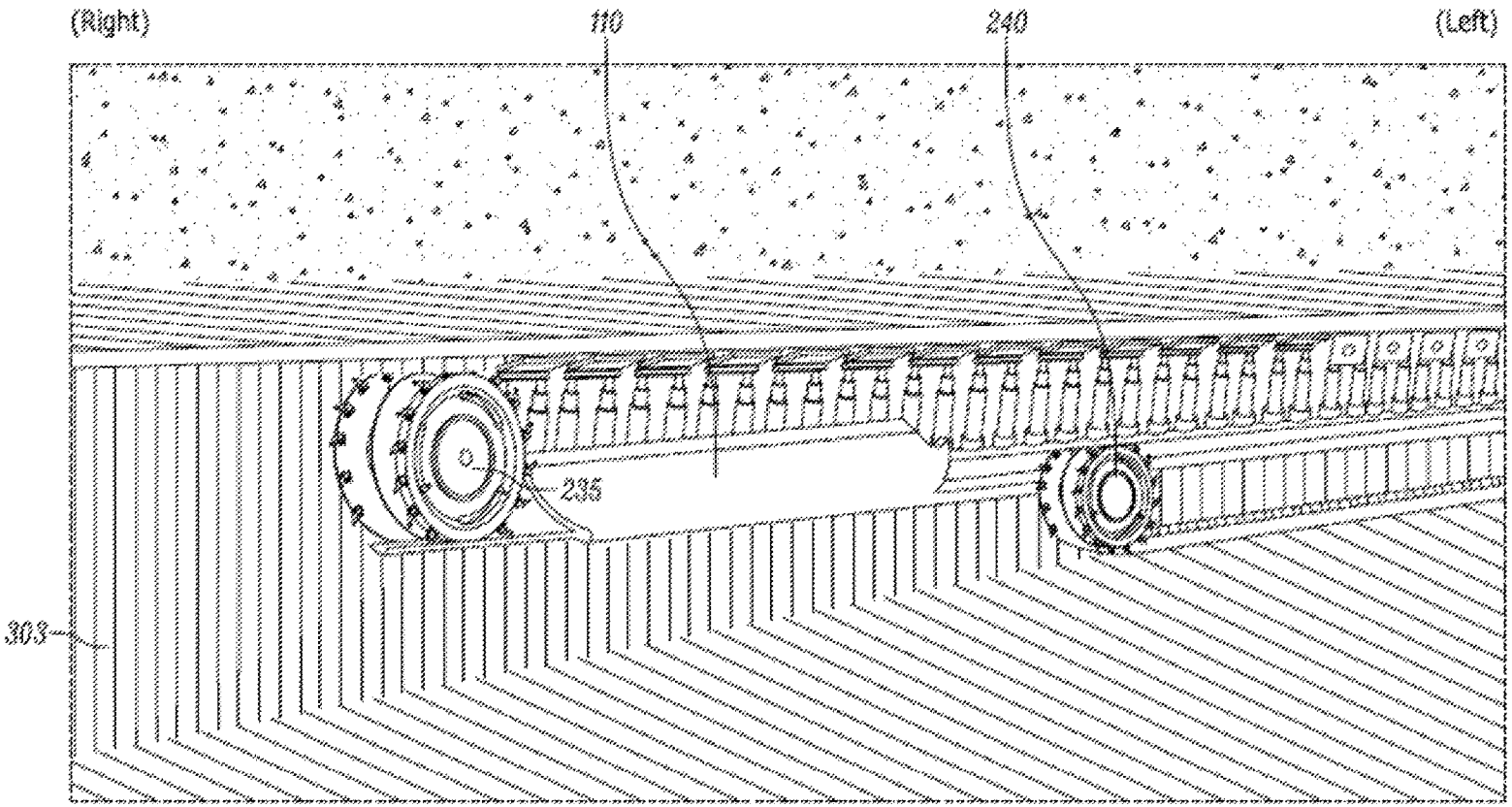
FIG. 6 illustrates a longwall shearer as it passes through a coal seam.

FIG. 6 illustrates the longwall shearer 110 as it passes along the width of a coal face 303. As shown in FIG. 6, the shearer 110 can displace laterally along the coal face 303 in a bi-directional manner, though it is not necessary that the shearer 110 cut coal bi-directionally. For example, in some mining operations, the shearer 110 is capable of being propelled bi-directionally along the coal face 303, but only shears coal when traveling in one direction. For example, the shearer 110 may be operated to extract one web of coal over the course of a first, forward pass over the width of the coal face 303, but not extract another web of coal on its returning pass. Alternatively, the shearer 110 can be configured to extract one web of coal during each of the forward and return passes, thereby performing a bi-directional cutting operation. As shown in FIG. 6, the left cutter 240 and the right cutter of the shearer 110 are staggered to accommodate the full height of the coal seam 345 being mined. In particular, as the shearer 110 displaces horizontally along the conveyor 115, the left cutter 240 is shown shearing coal away from the bottom half of the coal face 303, while the right cutter 235 is shown shearing coal away from the top half of the coal face 303. When the shearer 110 reaches the end of the coal face 303 after the first pass, there may be a delay before the shearer 110 begins the second pass and returns to the opposite end of the coal face 303. This is due in part to the fact that the leading cutting (left cutter 240 in FIG. 6) reaches the end of the coal face 303 prior to the trailing cutting (right cutter 235 in FIG. 6).

Figure 7:
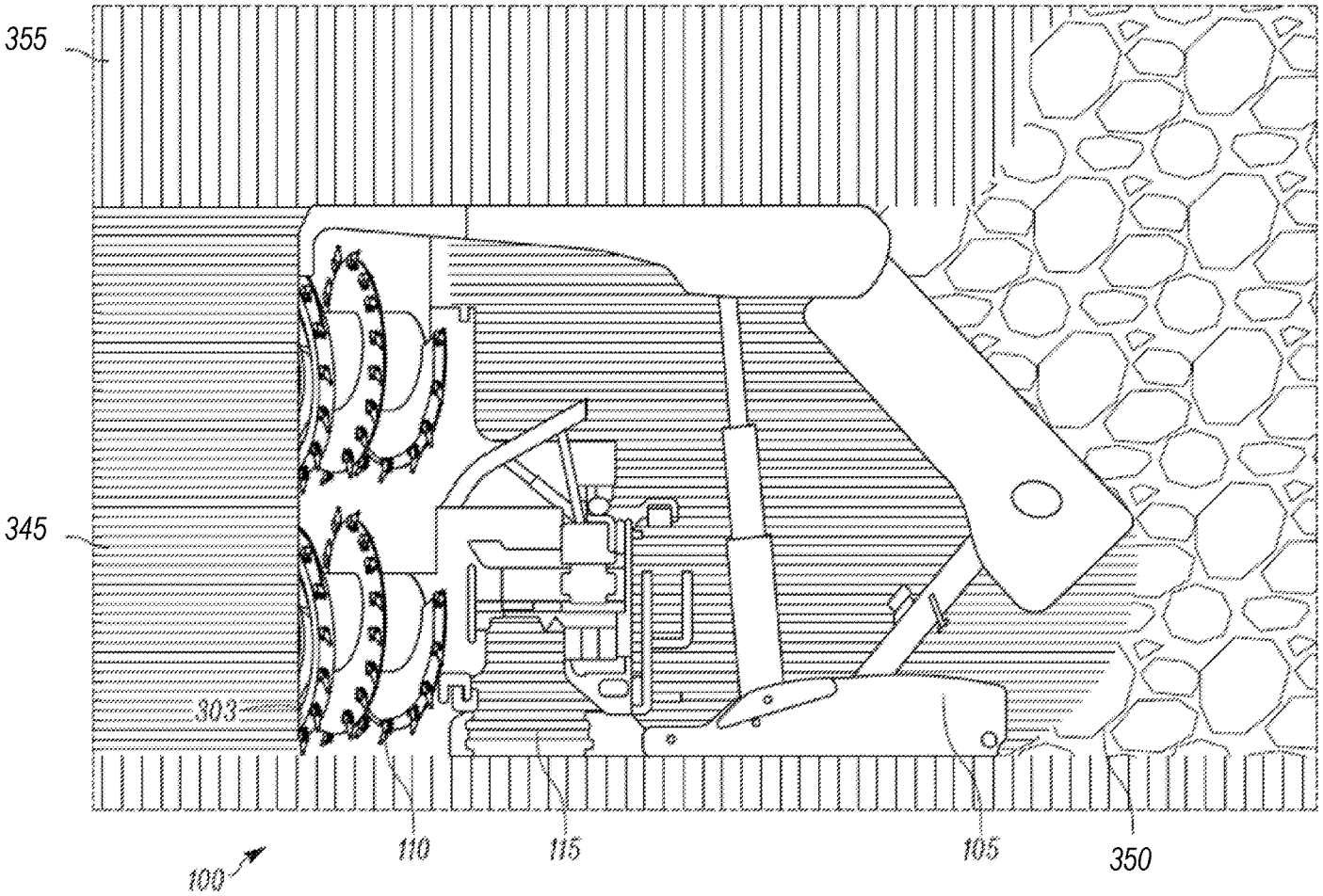
FIG. 7 illustrates the mining system of FIG. 1 advancing through a coal seam.

FIG. 7 illustrates the mining system 100 advancing through a coal seam 345 as the shearer 110 removes coal from the coal face 303. As coal is sheared away from the coal face 303, the geological strata 355 overlying the excavated regions are allowed to collapse behind the mining system 100 as the mining system 100 advances through the coal seam 345. In particular, the coal face 303 as illustrated in FIG. 7 extends perpendicularly from the plane of the figure. As the mining system 100 advances through the coal seam 345 (to the left, in FIG. 7), the strata 355 is allowed to collapse behind the system 100, forming a goaf 350.

Figure 8:
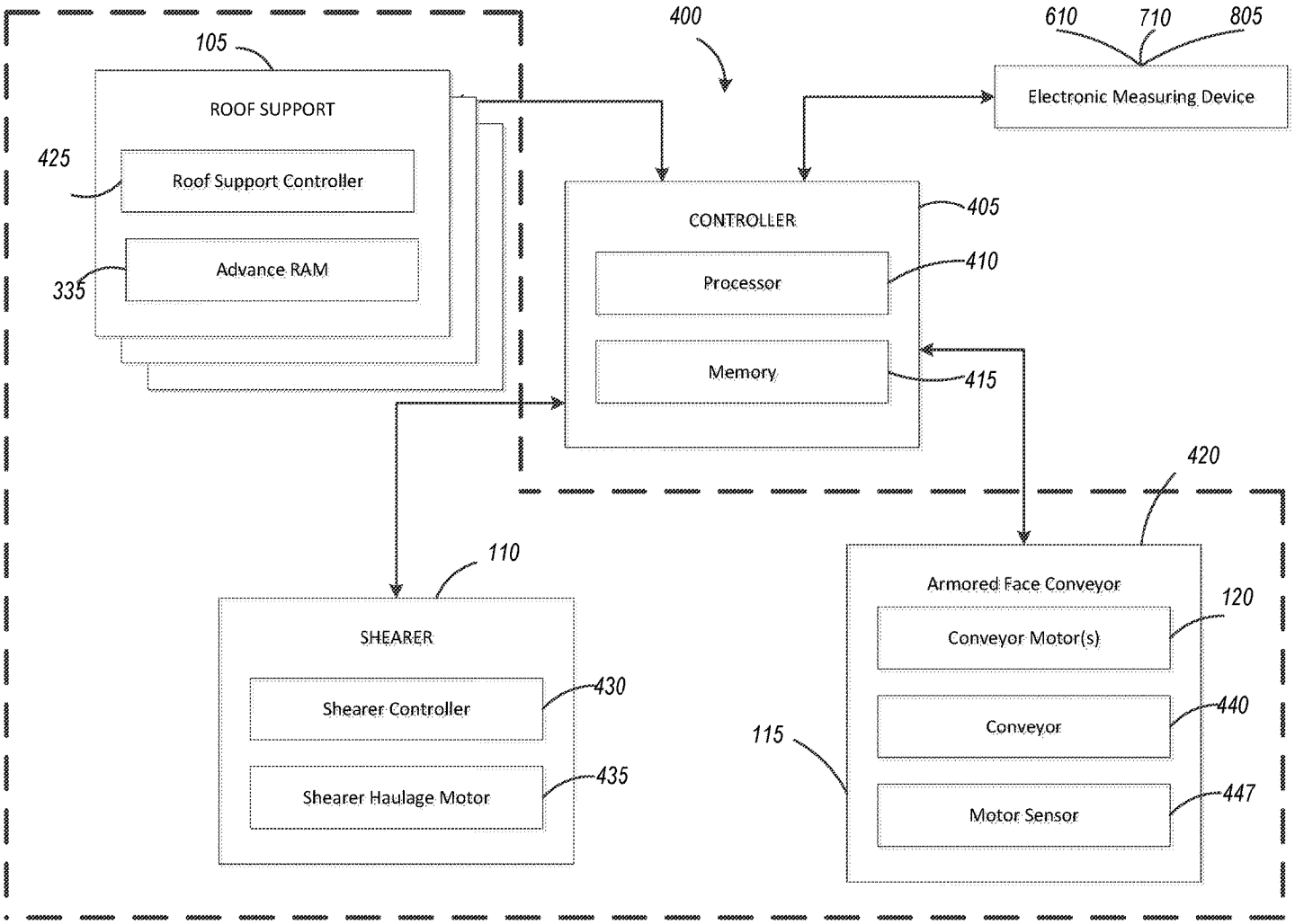
FIG. 8 is a schematic diagram of an optimization control system according to one embodiment of the invention.

FIG. 8 is a schematic diagram of the optimization control system 400. The optimization control system 400 includes a controller 405 having a processor 410 and a memory 415. The controller 405 is in communication with a plurality of controllable components 420. For example, the controller 405 is in communication with the roof supports 105, the shearer 110, and the conveyor 115. In some embodiments, each of the controllable components 420 may have its own controller that communicates with the main controller 405. Likewise, each of the controllable components 420 may have its own motor or hydraulic system to operate the controllable component 420. For example, in the illustrated embodiment shown in FIG. 8, the roof support 105 includes a roof support controller 425 and an advance ram 335, the shearer 110 includes a shearer controller 430 and a shearer haulage motor 435, and the conveyor 115 includes a conveyor controller 440 and a conveyor motor 120. The conveyor 115 also includes motor sensors 447, which can be used to monitor the speed, torque, or power of the conveyor motor 120. In the illustrated embodiment, the advance ram 335 is a part of a hydraulic system. In some embodiments, the controllable components 420 may each have multiple motors. In addition, in some embodiments the controllable components 420 do not have a component specific controller 425, 430, 440, but are controlled directly through the main controller 405.

The controller 405 controls and adjusts the controllable components 420 in order to help optimize the efficiency and the volume of mineral extracted while also extending the life of the longwall mining system 100. The extraction of mineral is not executed at a constant rate at all times. For example, there is a lag when the shearer 110 reaches the end of the coal face 303 and must change directions to begin shearing in the opposite direction. Likewise, the shearer 110 haulage speed may be varied at times depending on the conditions. Generally, the faster the haulage speed, the faster the shearer 110 moves along the coal face, and the higher the rate of mineral extraction. When the amount of mineral on the conveyor 115 exceeds a certain volume, the conveyor motor 120 may be overloaded, which can cause stress and wear on the conveyor motor 120. When the amount of mineral on the conveyor 115 is under a certain volume, the conveyor motor 120 may be underloaded, causing a loss in efficiency of mineral extraction. The controller 405 is configured to control the controllable components 420 in a manner that balances the two goals of extracting mineral efficiently and at large volumes, while also extending the life of the longwall mining system 100 by reducing overload and deterioration of the conveyor motors 120.

Figure 9:
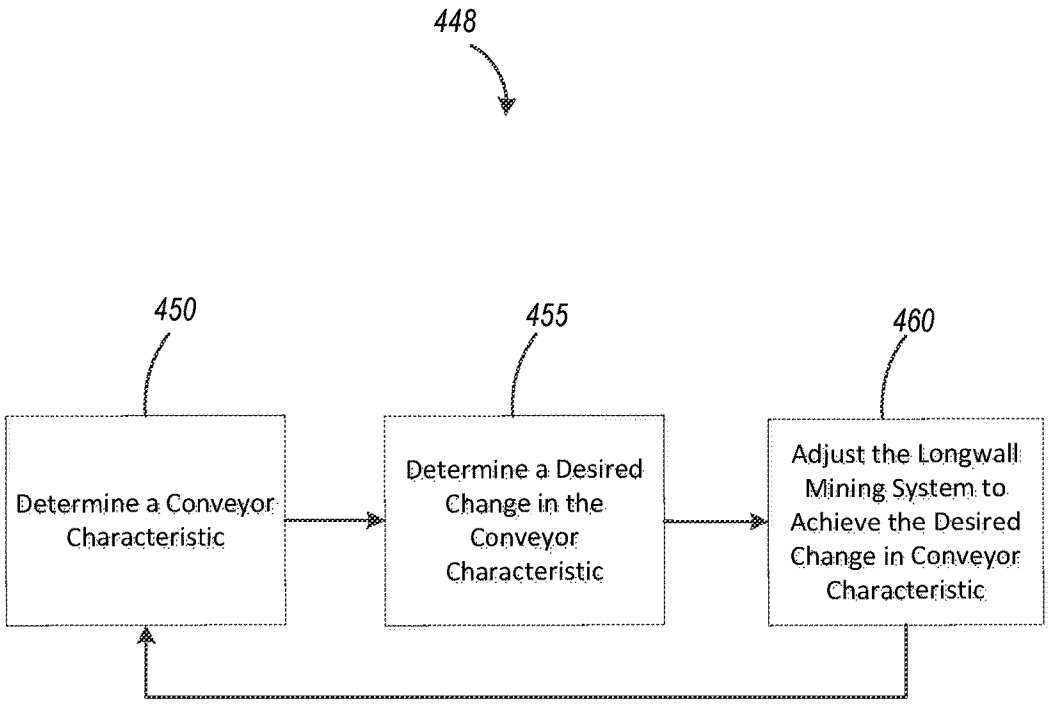
FIG. 9 is a flow chart illustrating a method of controlling a longwall mining system according to the optimization control system of FIG. 8.

FIG. 9 illustrates a method 448 for optimizing the longwall mining system 100 according to some embodiments. The method 448 is described with respect to optimization control system 400, although other components may be used to implement the method 448 in some embodiments. The controller 405 optimizes the longwall mining system 100 by monitoring at least one conveyor characteristic. The monitored conveyor characteristic can include, but is not limited to, the torque on the conveyor motor 120, the motor speed of the conveyor motors the power input to the conveyor motor 120, or the amount of mineral on the conveyor 115. The monitored characteristic is compared to a desired value to determine a desired change in conveyor characteristic (step 455). The desired value may be a predetermined set point or range for the conveyor characteristic. The desired change may be the difference between the current value of the monitored conveyor characteristic and the desired value. Once the desired change in conveyor characteristic is determined, the controller 405 adjusts the controllable components 420 of the longwall mining system 100 to achieve the desired change in conveyor characteristic (step 460). For example, the controller 405 can adjust the operation of the roof supports 105, the haul speed of the shearer 110, the speed of the conveyor 115, or a combination thereof. In some embodiments, the controller 405 executes one or more commands to adjust the controllable components 420 according to a command hierarchy. The command hierarchy indicates a preference level for each of the commands. The hierarchy does not specify which commands are executed, but only indicates the preference level for the available commands.

A command hierarchy includes two or more commands that are ranked relative to one another in order of preference. When a plurality of commands are executed according to a command hierarchy, the highest ranking command that is available is executed. As but one example, a particular command may not be available, if the command is to increase a variable that is already set at a maximum level. Thus, the particular action taken when executing commands according to a command hierarchy depends on circumstances of the situation. An example of executing commands according to a command hierarchy is explained in further detail below with reference to FIG. 21.

FIGS. 10-20 illustrate different embodiments for determining a conveyor characteristic (step 450). In the embodiments illustrated in FIGS. 10-20, the conveyor characteristic being monitored is a load profile. The load profile is a representation of the amount of mineral on the conveyor 115. In the illustrated embodiment, the load profile is created based on the height of the mineral on the conveyor 115 over a distance along the conveyor 115. In other embodiments, the load profile accounts for the amount of mineral on the conveyor 115 based on other measurable quantities. For example, in some embodiments, the load profile is a representation of the weight or volume of the mineral on the conveyor 115. Although the following methods create a load profile based on the height of the mineral on the conveyor 115, it should be understood that similar methods can be used to create a load profile based on the weight or volume of mineral on the conveyor 115.

Figure 10:
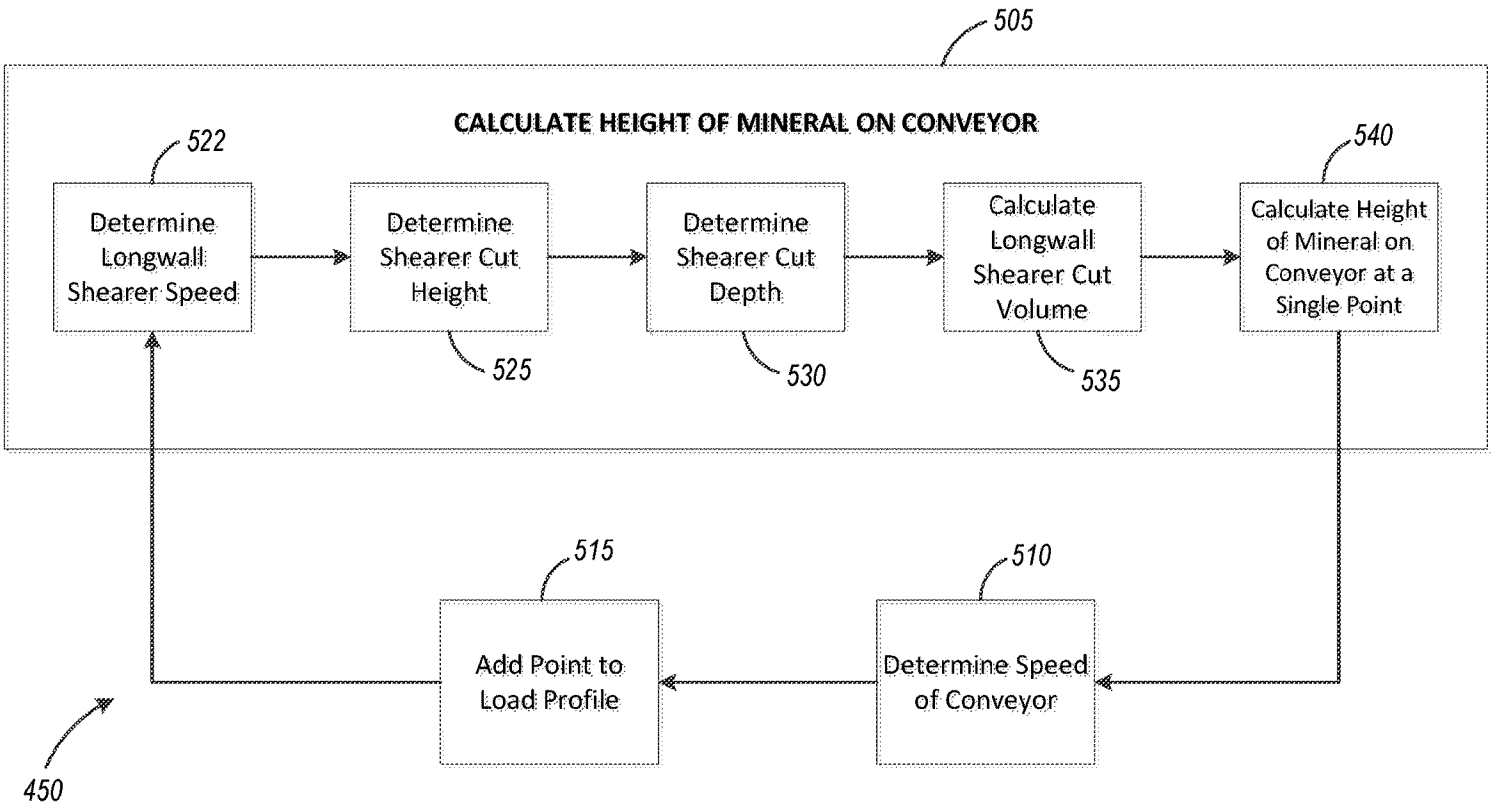
FIG. 10 is a flowchart illustrating a method of creating a load profile according to one embodiment.

FIG. 10 illustrates a method 500 of determining a conveyor characteristic (step 450) according to one embodiment of the invention. In method 500, the controller 405 builds a load profile by adding points to the load profile that represent the pile height of the mineral on the conveyor 115 and the speed of the conveyor 115. Specifically, the controller 405 calculates the pile height of the mineral on the conveyor 115 (step 505) using a mineral height estimation calculation, which serves as the y-coordinate for that load profile point. The controller 405 determines the x-coordinate using the speed of the conveyor 115 and the elapsed time since the previous calculation (step 510). The controller 405 then adds the load profile point to the conveyor load profile (515). As the conveyor 115 moves, the controller 405 repeats steps 505-515 to continue adding points to the load profile. Each time the controller 405 adds a point to the load profile, the load profile becomes longer, meaning it represents the mineral height along a greater length of the conveyor 115.

Figure 11:
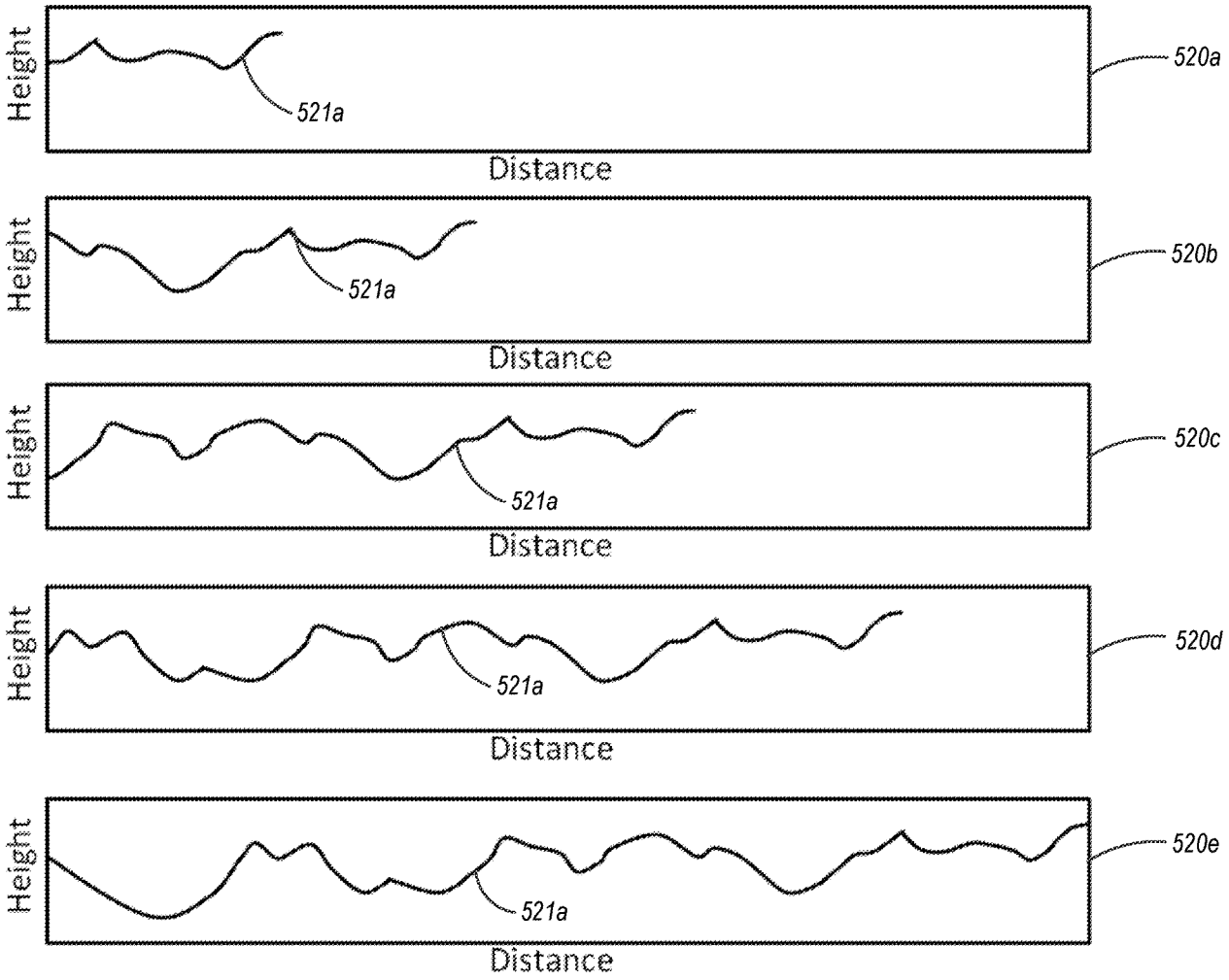
FIG. 11 illustrates a series of snapshots graphically representing a load profile as it is built according to the method of FIG. 10 and FIG. 12.

FIG. 11 visually depicts a load profile 521 as it is generated. Specifically, FIG. 11 provides snapshots 520*a*-520*e* of a load profile 521 as it is built by the controller 405. The snapshots 520*a*-520*e* graphically show the height of the mineral along a length of the conveyor 115. In each of the progressive snapshots 520*a-e* the load profile 521*a-e* represents the height of the mineral along a greater length of the conveyor 115. The controller 405 repeatedly calculates the pile height (step 505), determines the speed of the conveyor (step 510), and adds the point to the load profile (step 151). As new points are added to the load profile 521, the load profile 521 becomes longer such that the height of the mineral is known across a greater length of the conveyor 115. In the first snapshot 520*a* with the load profile 521*a*, the pile height is only known across a first length of the conveyor 115. However, in the later snapshots (e.g., 520*d*, 520*e*), the load profile (e.g., 521*d*, 521*e*) is generated for a longer length of the conveyor 115. Although FIG. 11 visually depicts the load profile as a graph showing the height of the mineral along a distance/length of the conveyor 115, in other embodiments, the load profile simply comprises of a list of points. That is, in some embodiments, the controller 405 does not actually graph the points of the load profile.

In some embodiments the controller 405 calculates the pile height of the mineral (step 505) according to the sub-flow chart of FIG. 10 including steps 522-540. The controller 405 determines the haulage speed ($V_s$) of the shearer 110 (step 522), the height ($H_c$) of the shearer 110 above the conveyor 115 (step 525), and the depth of the cut ($D_c$) of the shearer 110 (step 530). The controller 405 determines the depth of cut ($D_c$) based on the most recent average advance distance of the conveyor 115 (step 530) and calculates the shearer 110 cut volume (step 535). These values may be determined in various orders. The controller 405 then uses these measurements to calculate the height ($H_m$) of the mineral on the conveyor 115 at a single point (step 540). For example the mineral pile height ($H_m$) can be calculated using the following equation.

$$H_m=(V_s \times H_c \times D_c)/V_r$$

Where $V_r$ is the relative speed of the conveyor 115 to the shearer 110 and $V_r=V_{AFC}\pm V_{LWS}$, where $V_{AFC}$ represents the speed of the conveyor 115 and $V_{LWS}$ represents the speed of the shearer 110. When the shearer 110 is moving in a direction opposite the conveyor 115 $+V_{LWS}$ is used and when the shearer 110 is moving in a direction with the conveyor 115, $-V_{LWS}$. As previously explained, the controller 405 uses the pile height value and the speed of the conveyor 115 to plot a point on the conveyor profile and build the conveyor load profile (step 515).

Figure 12:
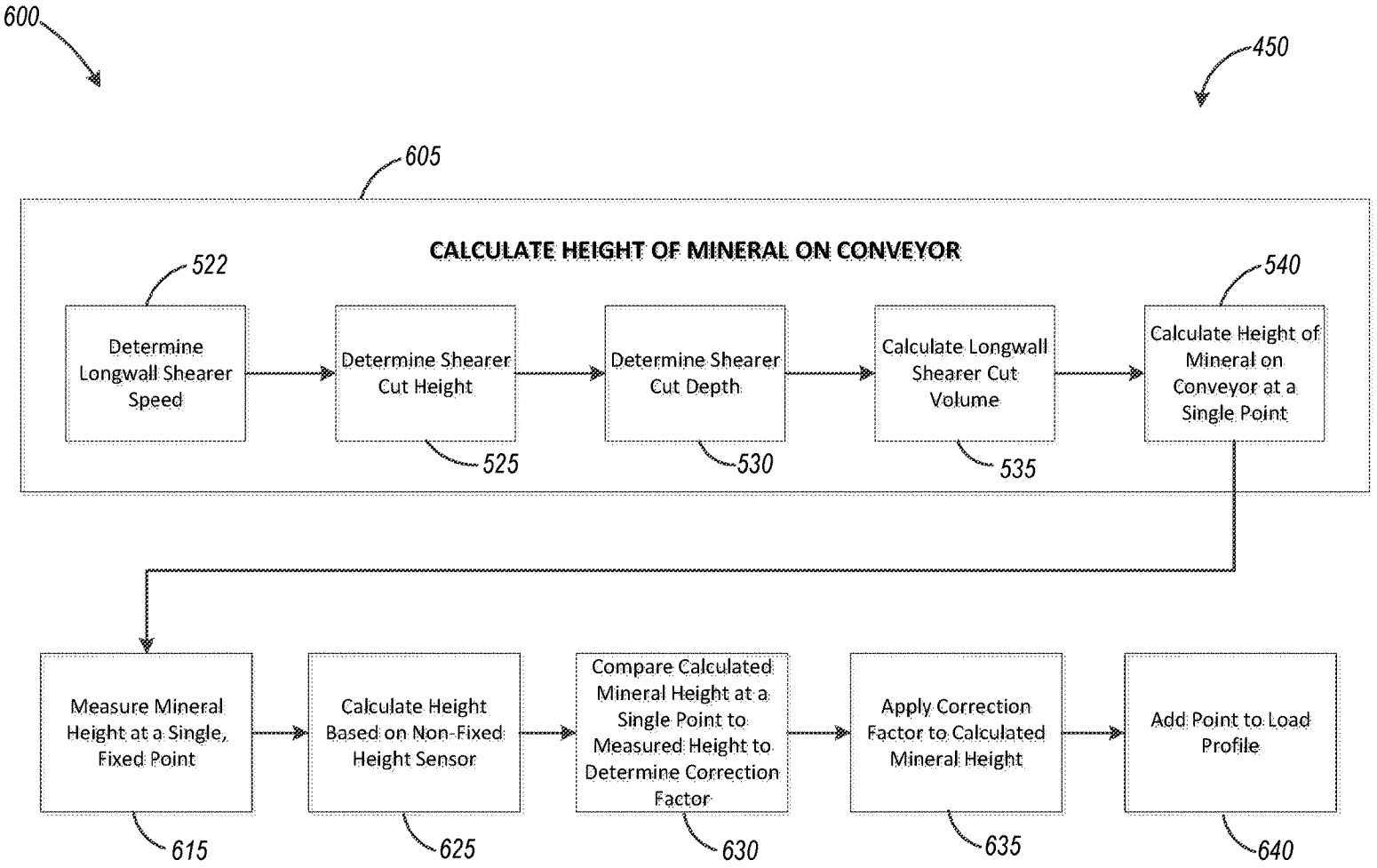
FIG. 12 illustrates a flow chart of a method of determining a load profile according to another embodiment.
Figure 13:
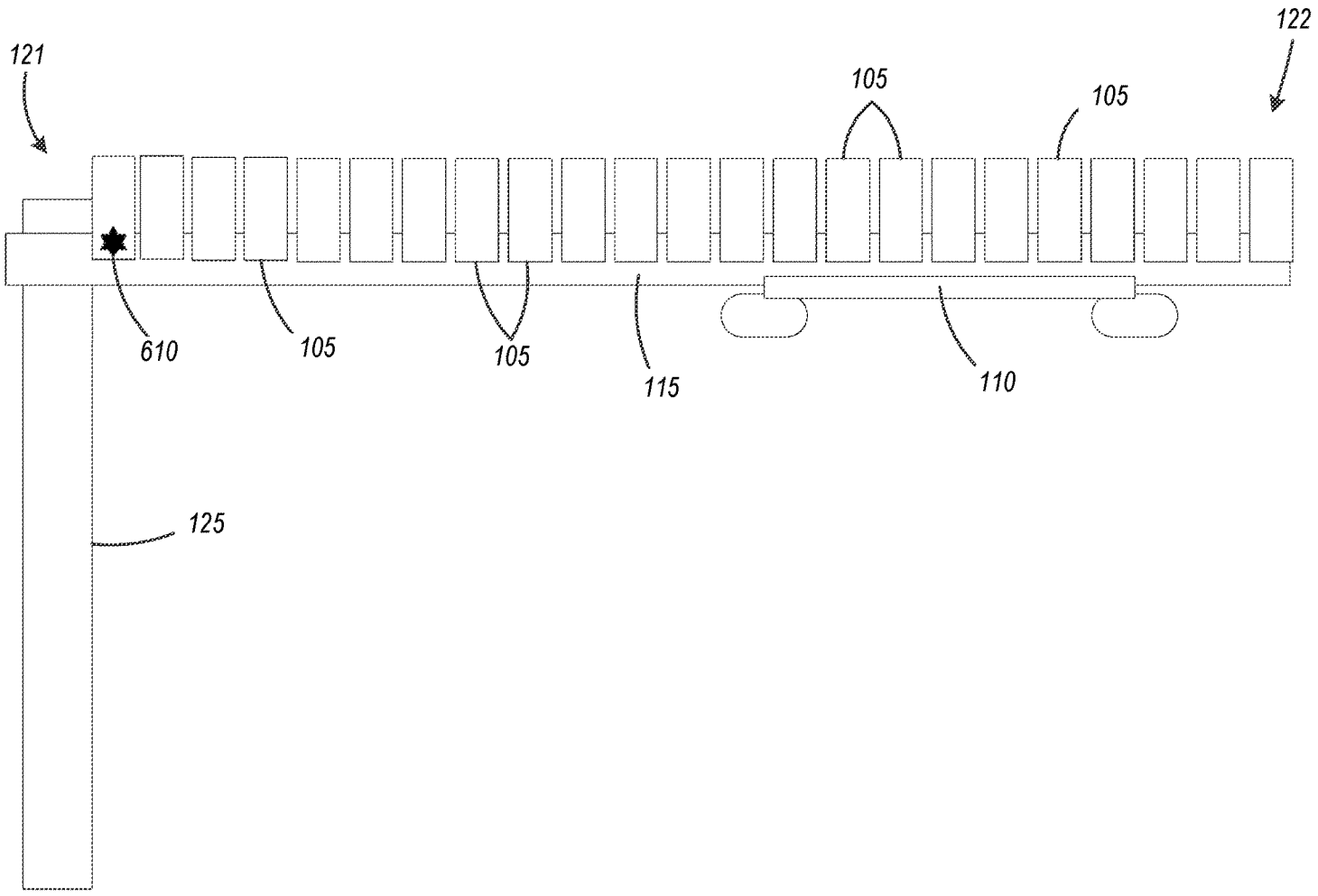
FIG. 13 illustrates a schematic diagram of a longwall mining system having an electronic measuring device according to one embodiment.

FIG. 12 illustrates a method 600 of determining a load profile that utilizes both a calculated pile height and a measured pile height to create load profile points. The method 600 calculates the height of the mineral on the conveyor 115 (step 605). The method 600 can use a similar calculation as that described above with respect to method 500 (steps 522-540). However, in addition to calculating the pile height (step 605), the method 600 also utilizes an electronic measuring 610 device to create the conveyor load profile. More particularly, in step 615 the controller 405 measures the height of the mineral on the conveyor 115 with the aid of the electronic measuring device 610 positioned along the conveyor 115 (see FIG. 13). The electronic measuring device 610 can include a sonar sensor, radar sensor, or other known electronic measuring device capable of sensing the height of the mineral. If the load profile is a representation of weight rather than height, a weight sensor can be used in place of a height sensor. The electronic measuring device 610 is positioned generally above a location along the conveyor 115 that is suitable to measure the height of the mineral on the conveyor 115. For example, in the embodiment illustrated in FIG. 13, the electronic measuring device 610 is coupled to a power roof support 105 that is proximate the maingate 121. However, the electronic measuring device 610 can be placed at another location along the length of the conveyor 115 in the other embodiments.

The electronic measuring device 610 is fixed to the roof support 105 and the conveyor 115 moves horizontally along a coalface (i.e. right to left in FIG. 13) beneath the electronic measuring device 610. The horizontal movement is based on the rotation of the conveyor 115 as the conveyor 115 transports mineral along the length of the conveyor 115. In addition, the conveyor moves vertically (i.e., up and down in the FIG. 7) relative to the roof supports 105 and to the electronic measuring device 610. The vertical movement is based on one or more of changes in the floor topography beneath the conveyor 115 and roof support 105, the extension of the arms 305 and 310 at the roof supports 105, the angle of the roof 315, and the "bouncing" or "shock absorbency" effect of the conveyor 115. This movement is accounted for by the electronic measuring device 610 to provide an accurate measurement.

Figure 22:
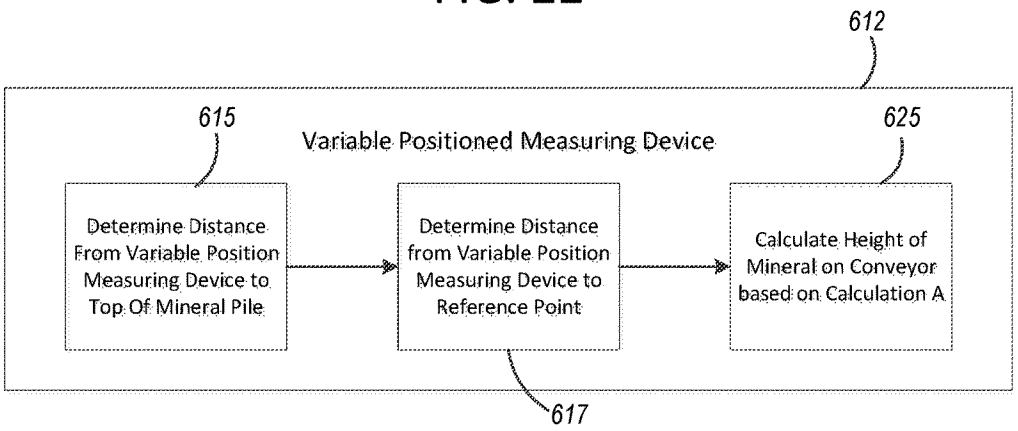
FIG. 22 is a flow chart illustrating a method of calculating the mineral pile height according to one embodiment.

An exemplary technique that is used to account for the relative vertical movement of the conveyor and electronic measuring device 610 is shown and described with respect to FIGS. 3 and 22. FIG. 3 illustrates the positioning of the electronic measuring device 610 on the roof support 105. The electronic measuring device 610 measures a distance ($D_m$) from itself to a top of the mineral pile on top of the conveyor 115. The electronic measuring device 610 also measures a distance ($D_r$) to a reference reflector 620. The controller 405 then uses the measured distances ($D_m$) and ($D_r$) to determine the height of the mineral above the conveyor 115. Specifically, the controller 405 receives ($D_m$) and ($D_r$) and then determines the measured height ($H_m$) of the mineral based on these two distances, for example, by using the following equation:

$$H_m=H_r-(D_m-D_r) \qquad \text{Calculation A}$$

$H_m$ represents the measured pile height above the top of the conveyor and $H_r$ represents the height of the reference reflector 620 above the top of the conveyor. The height ($H_r$) of the reference reflector 620 above the top of the conveyor is a known fixed value.

Once the controller 405 determines the measured pile height based on the sensed distances ($D_m$, $D_r$) provided by the electronic measuring device 605 (step 625), the controller 405 compares the measured pile height to the calculated pile height to determine a correction factor (step 630). The correction factor is essentially the discrepancy (i.e., error) between the calculated pile height and the measured pile height. The controller 405 applies the correction factor to the calculated pile height to determine a corrected pile height (step 635).

In one example, the calculated pile height is an estimation of the pile height at a position of the conveyor 115 near the shearer 110, while the measuring device 605 is positioned downstream at a position of the conveyor 115 near the maingate 121. As the distance between the shearer 110 and measuring device 605 increases, the latency increases between when mineral is added to the conveyor 115 by the shearer 110 cutting and when the height of that added mineral is measured downstream by the measuring device 605. This latency would reduce the effectiveness of using the measured pile height as an input to control the system to adjust the pile height (e.g., by altering the haul speed of the shearer 115). Rather, the more timely, calculated pile height may be used as an input to control the system to adjust the pile height, as discussed in further detail below. However, the measured pile height and correction factor are used to improve the accuracy of the calculated pile height. For instance, if the measured pile height shows that the calculated height is consistently lower than the actual pile height, the controller 405 may use a correction factor (e.g., add an offset) on future calculations to improve the accuracy of the calculated pile height.

The controller 405 uses the corrected pile height and the speed of the conveyor 115 to create load profile points to add to the load profile (step 640). Specifically, the corrected pile height serves as the y-coordinate and the speed of the conveyor 115 is used by the controller 405 to determine the x-coordinate for that particular load profile point. The controller 405 repeats steps 605-640 to build the load profile. The corrected load profile of method 600 is built in a similar way as load profile of method 500. As shown in FIG. 11, the load profile becomes larger as more points are added, representing the pile height along a greater length of the conveyor 115.

Figure 14:
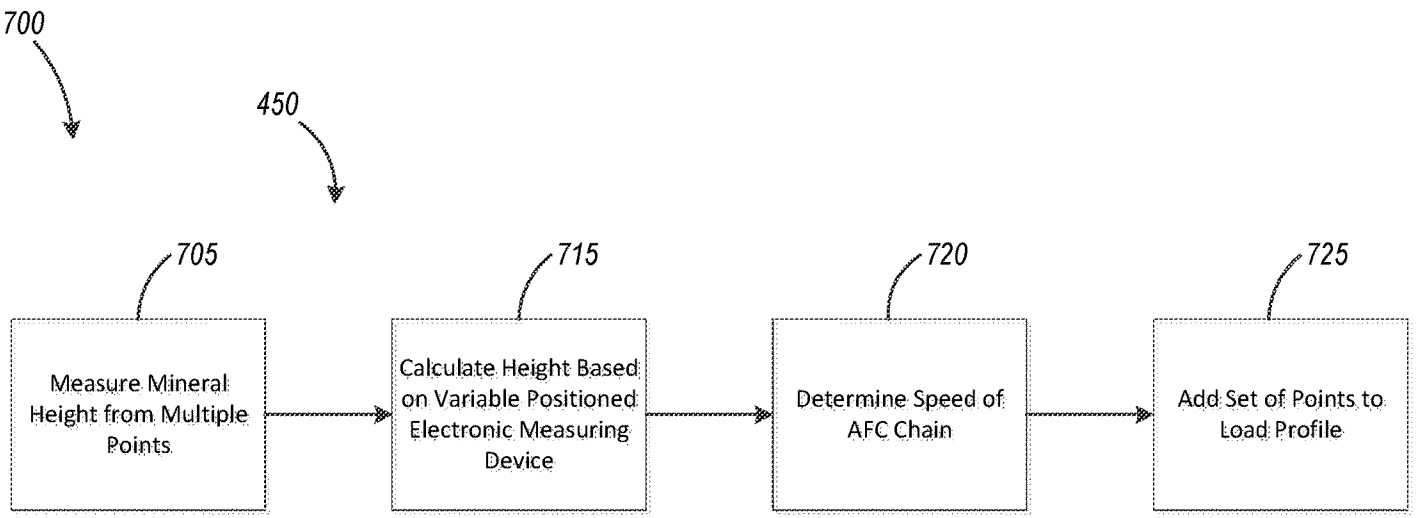
FIG. 14 illustrates a flow chart illustrating a method of creating a load profile according to another embodiment.
Figure 15:
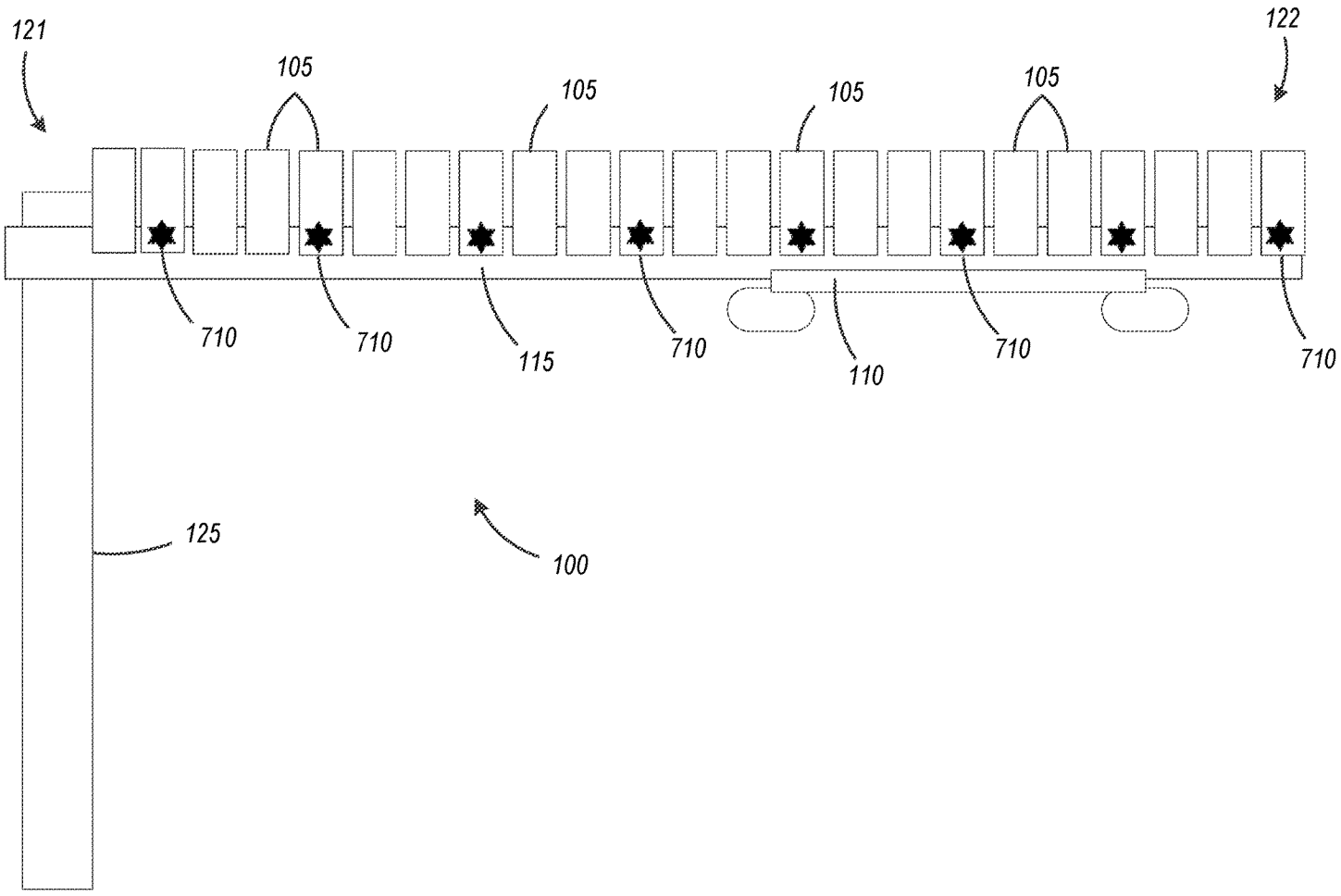
FIG. 15 is a schematic diagram of a longwall mining system having a plurality of electronic measuring devices according to one embodiment.

FIG. 14 illustrates another method 700 of determining a load profile to implement step 450 of FIG. 9. According to this embodiment, the controller 405 measures the height of the mineral from multiple points along the conveyor 115 by utilizing a plurality of electronic measuring devices (step 705). More particularly, as shown in FIG. 15, a plurality of electronic measuring devices 710 are coupled to a plurality of the roof supports 105. In the illustrated embodiment, the plurality of electronic measuring devices 710 are spaced apart at generally equal distances along the entire length of the conveyor 115. However, the number and positioning of the electronic measuring devices 710 can vary. Likewise, in other embodiments the plurality of measuring devices 710 may not be spaced apart at equal distances and may not extend along the entire length of the conveyor 115.

To build the load profile, the controller 405 measures the height of the mineral at a plurality of positions along the length of the conveyor 115 using the electronic measuring devices 710 (step 705). The controller 405 then uses the measurements from the electronic measuring devices 710 to calculate the height of the mineral on the conveyor (step 715). The controller 405 also determines the speed of the conveyor 115 using motor sensor 447 (step 720). The speed of the conveyor 115 and the height of the mineral on the conveyor is then used by the controller 405 to determine load profile points. Graphically, the pile height represents the y-value of each point and the speed of the conveyor 115 is used to determine the x-value. The controller 405 then adds this set of load profile points to the load profile (step 725). As the conveyor 115 moves, the controller 405 repeats steps 705-725. The controller 405 builds the load profile by repeatedly measuring the pile height on the conveyor 115 at a plurality of positions (step 705) and adding sets of points to the load profile (step 725).

Each electronic measuring device 710 measures the distance from itself to the top of the mineral pile. The controller 405 then uses this set of measurements to determine a set of load profile points, each representing the height of the mineral below an electronic measuring device 710. As described previously with respect to method 600, because the roof supports 105 and electronic measuring devices 910 are movable in the vertical direction relative to the conveyor 115, the controller 405 determines the measured pile height based on method 612 and Calculation A, which accounts the relative movement. The controller 405 receives two measurements ($D_m$ and $D_r$) from each electronic measuring device 710 (steps 615 and 617), and performs Calculation A for each pair of values in order to determine a measured pile height corresponding to each measuring device 710 (step 625). More specifically, each electronic measuring device 710 sends the controller 405 a sensed distance ($D_m$) from the measuring device 710 to the top of the mineral pile (step 615) and a sensed distance ($D_r$) from the measuring device 710 to a reference point 730 (step 617). Each measuring device 710 uses a different reference point 730 corresponding to that measuring device 710. The controller 405 inputs each pair of values into Calculation A to determine a set of measured heights (step 625). The controller 405 uses the set of measured heights to determine a set of load profile points that will be added to the load profile (step 725).

Figure 16:
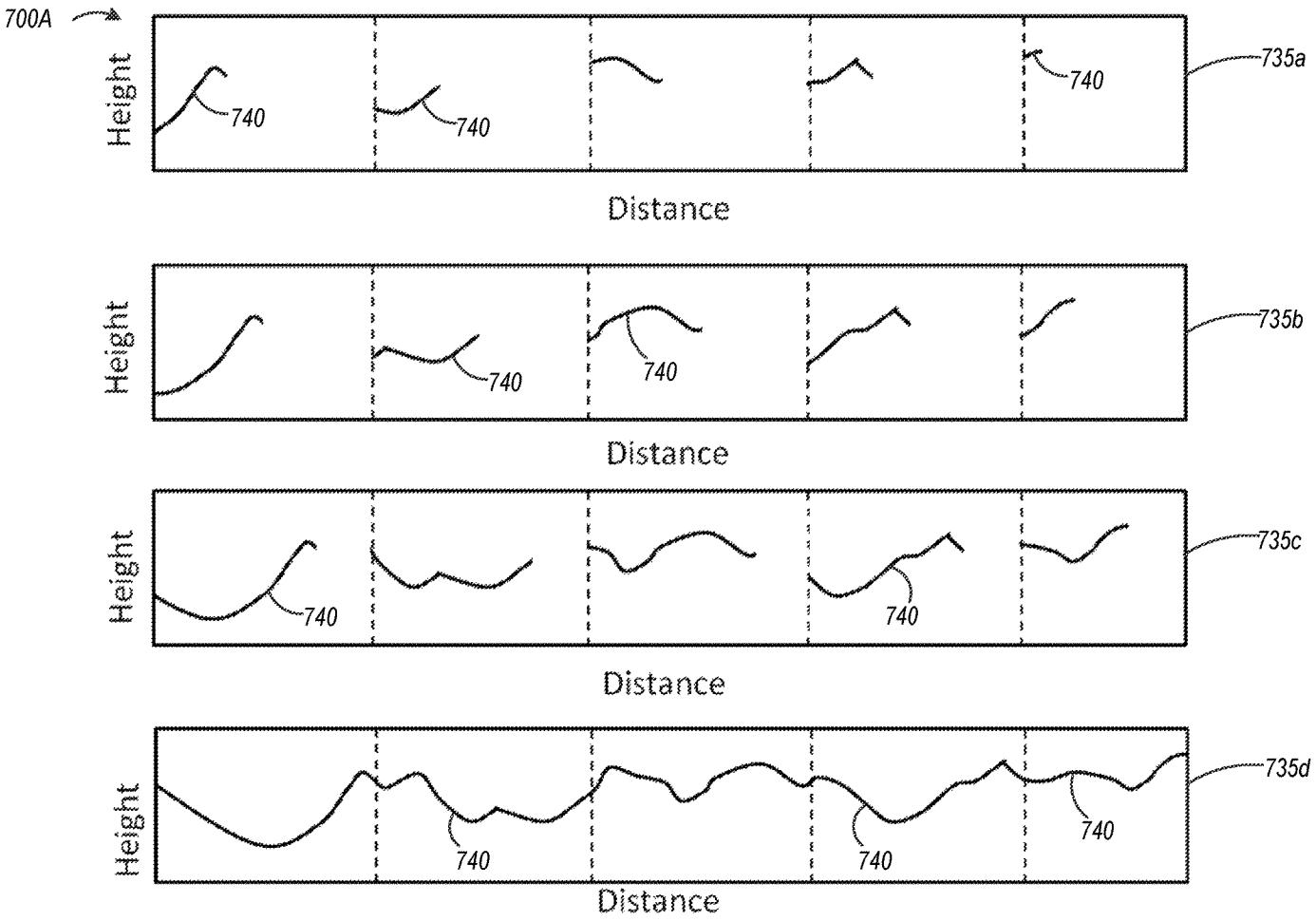
FIG. 16 illustrates a series of snapshots graphically representing a load profile as it is built according to the method of FIG. 14.

In the method of FIG. 14, the load profile can be built in two ways. First, FIG. 16 illustrates a technique 700A of building a load profile using a similar procedure as shown in FIG. 11. FIG. 16 shows a series of snapshots 735*a*-735*d* of the load profile as it is being built. In this embodiment, the controller 405 repeatedly adds points to the load profile to generate the load profile along a length of the conveyor 115. Every time the controller 405 adds points the load profile, the segments 735*a*-735*d* becomes larger and corresponds to a greater length of the conveyor 115. In this embodiment, the controller 405 uses both the measured heights and the speed of the conveyor 115 to determine load profile points. Unlike the load profile shown in FIG. 11, the load profile of FIG. 16 is built using a plurality of electronic sensing devices 710. In the embodiment of FIG. 16, the controller 405 adds sets of load profile points to the load profile rather than a single point at a time. Each set of points includes one point corresponding to each electronic measuring device 710. As illustrated in FIG. 16, when the controller 405 builds the load profile using sets of points, the load profile is generated in segments 740. Each segment corresponds to the measurements taken by a particular electronic measuring device 710. The snapshots 735*a*-735*d* show the load profile as it is generated by the controller 405. As sets of points are added to the load profile, each segment 740 of the load profile becomes larger and represents a greater length of the conveyor 115. Eventually, the individual segments 740 will overlap and the load profile will be represented as a single unified load profile, as shown in the last snapshot 735*d*.

Figure 17:
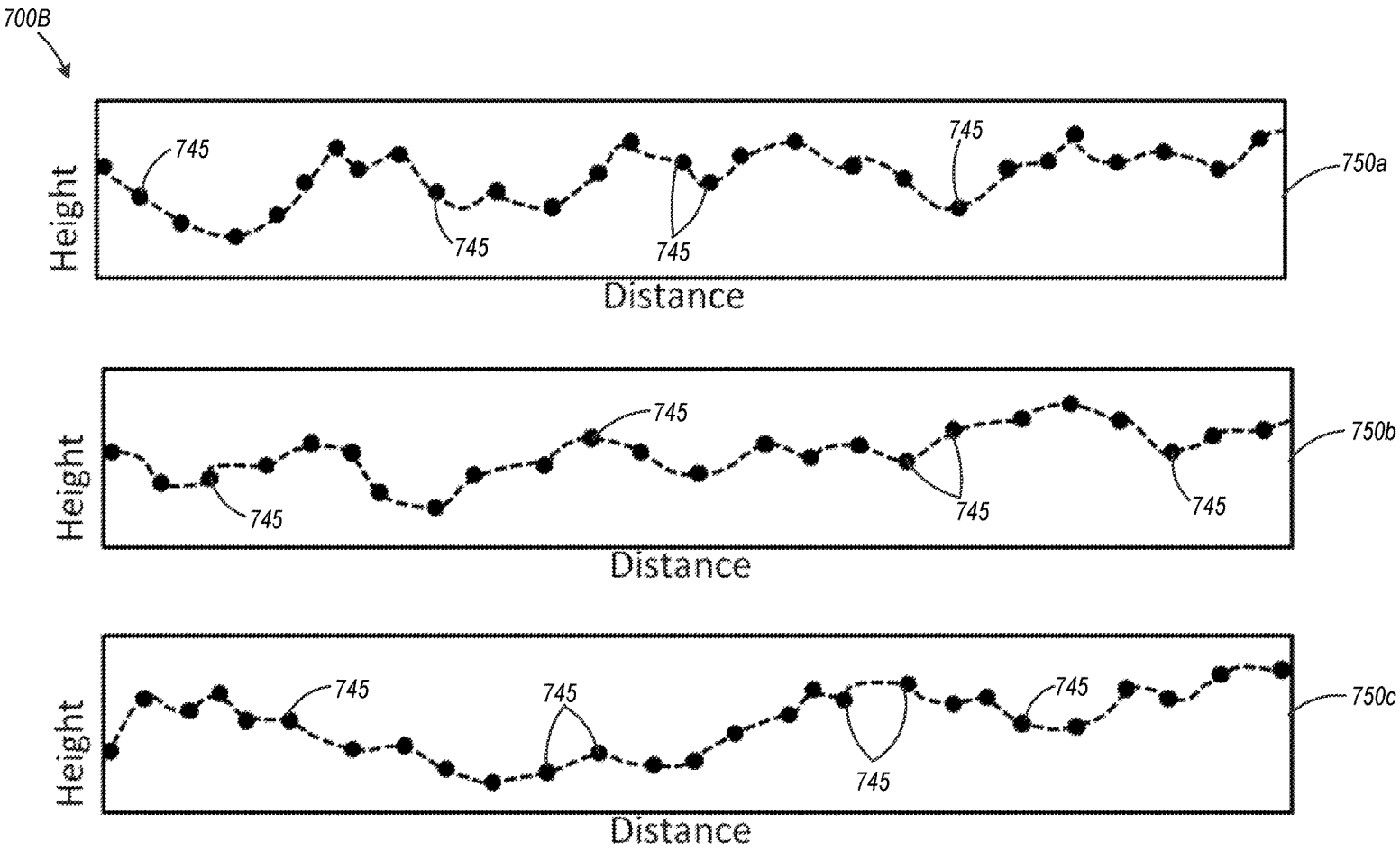
FIG. 17 illustrates a series of snapshots graphically representing a load profile as it is built according to another embodiment of method of FIG. 14.

FIG. 17 illustrates another technique 700B of building the load profile based on the method 700 of using multiple electronic measuring devices 710 coupled to the roof supports 105. According to this embodiment, the controller 405 creates a load profile based on a single set of load profile points 745 without accounting for the speed of the conveyor 115. The load profile is composed of a single set of load profile points 745, where each point 745 in the set corresponds to one of the electronic measuring devices 710. Each point 745 represents the height of the mineral at a position along the conveyor 115 corresponding to the location of a particular measuring device 710. In other words, the load profile is not a compilation of several sets of points 745, where each set of points 745 represents a new position of the conveyor 115, as illustrated in FIG. 16. Instead, in the embodiment of FIG. 17, the controller 405 generates the load profile based on a single set of points 745 representing the conveyor 115 in a stationary position. As the conveyor 115 moves, the controller 405 builds a new load profile by adding the new set of points 745 generated by the electronic measuring devices 710 to the load profile, and removing the previous set of points 745. FIG. 17 illustrates several load profiles 750*a*-750*c* that are each generated by the controller 405 using a single set of points 745.

Figure 18:
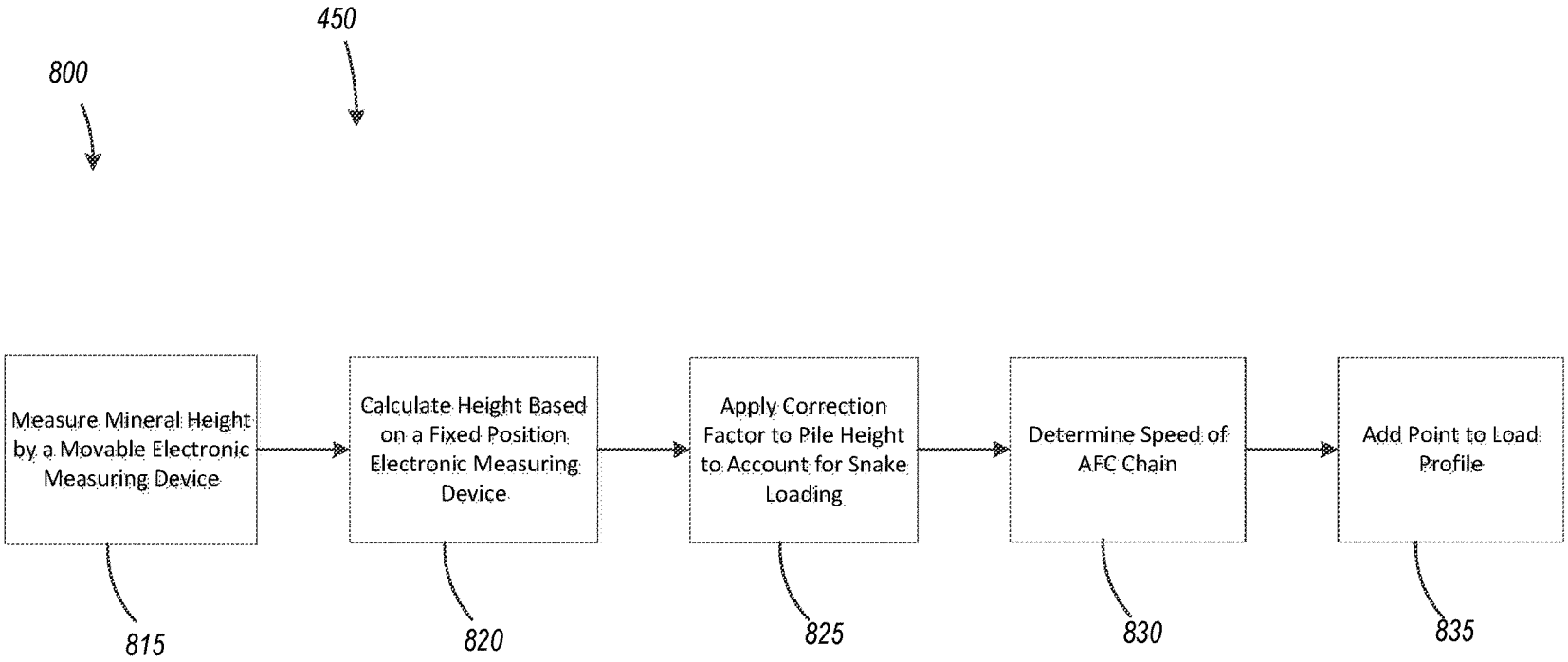
FIG. 18 a flow chart illustrating a method of creating a load profile according to another embodiment.
Figure 19:
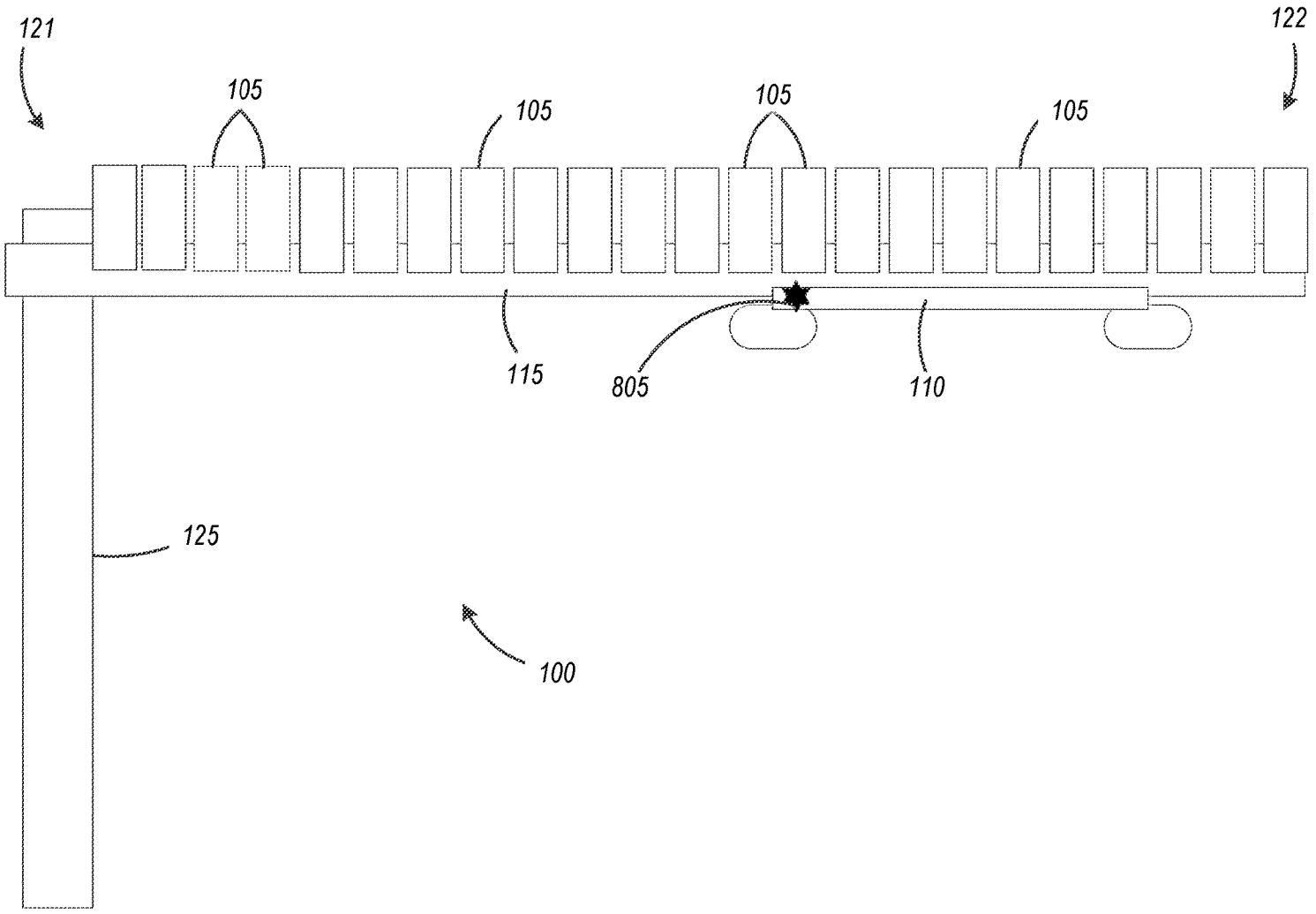
FIG. 19 is a schematic diagram of a longwall mining system having an electronic measuring device according to one embodiment

FIG. 18 illustrates a method 800 of determining a load profile using an electronic measuring device coupled to the shearer 110. More particularly, as shown in FIG. 19, an electronic measuring device 805 is coupled to the shearer 110 and is capable of moving in a horizontal direction with the shearer 110. In the illustrated embodiment, only one electronic measuring device 805 is used, however, in other embodiments a plurality of measuring devices 805 are used. The shearer 110 and the measuring device 805 move relative to the conveyor 115 while the shearer 110 cuts along the coal face 303. As the shearer 110 and the measuring device 805 move horizontally along the coal face 303, the measuring device 805 measures the height of the mineral on the conveyor 115 from different positions along the length of the conveyor 115 at different times. The controller 405 uses each of these measurements to create load profile points 810 that are added to the load profile to build the load profile.

More specifically, as shown in FIG. 4, the electronic measuring device 805 measures the distance ($D_m$) between itself and the top of the mineral pile and sends the measurement to the controller 405 (step 815). The controller 405 uses the measured distance ($D_m$) provided by the electronic measuring device 805 to determine the height ($H_m$) of the mineral above the conveyor 115 (step 820). The controller 405 uses the measurement provided by the electronic measuring device 805 to determine the height of the mineral above the conveyor 115 to represent the y-coordinate of the load profile point 810. In some embodiments, the controller 405 applies a correction factor to the measured height that accounts for snake loading to determine a corrected pile height, which is used as the y-coordinate (step 825). The controller 405 also determines the speed of the conveyor 115 (step 830) and the speed of the shearer 110 relative to one another determine the x-coordinates of a load profile point 810. The conveyor 115 and the shearer 110 may be moving at different speeds in the same direction or may be moving in entirely different directions. The controller 405 then adds the load profile point 810 to the load profile (step 835). These steps 815-835 are repeated by the measuring device 805 and the controller 405 to build the load profile.

Figure 23:
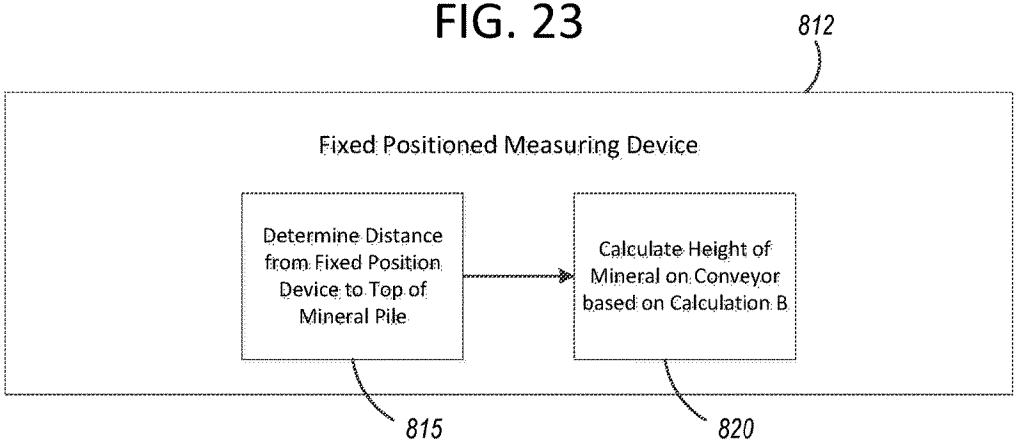
FIG. 23 is a flow chart illustrating a method of calculating the mineral pile height according to another embodiment.

The controller 405 determines the height of the mineral on the conveyor 115 based on the measurement ($D_m$) provided by the electronic measuring device 805 and an equation that accounts for mounting the measuring device 805 relative to the conveyor 115. FIG. 23 illustrates a method 812 of calculating the pile height for this arrangement. The method 812 includes determining a distance from the electronic measuring device 805 to the top of the mineral pile (step 815). The method further includes the controller 405 obtaining the known height of the electronic measuring device 805 above the conveyor 115, e.g., from the memory 415. The controller 405 then calculates the height of the mineral on the conveyor 115 based on Calculation B.

$$H_m = H_d - D_m \qquad \text{Calculation B}$$

Although the measuring device 805 moves relative to the conveyor 115 in a horizontal direction, the measuring device 805 is fixed relative to the conveyor 115 in a vertical direction. Accordingly, because the measuring device 805 is fixed vertically relative to the conveyor 115, the measuring device 805 does not take a second measurement from a reference point, as done in methods 600 and 700.

$H_m$ is the measured pile height above a top surface (i.e., deckplate) of the conveyor 115 deckplate. $D_m$ is the distance from the measuring device 805 to the top of the mineral pile. $H_d$ represents the height of the measuring device 805 above the deckplate.

Figure 20:
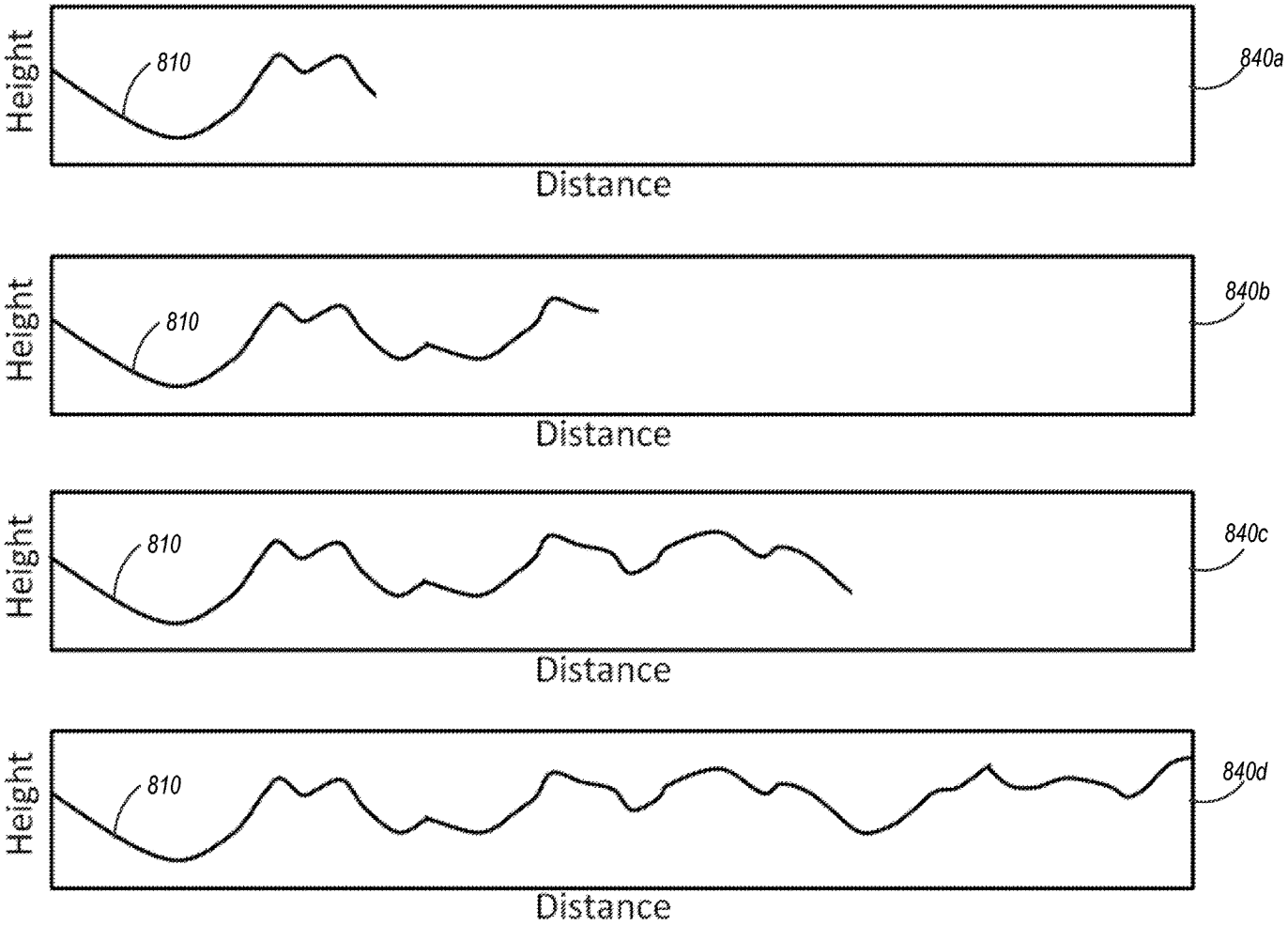
FIG. 20 illustrates a series of snapshots graphically representing a load profile as it is built according to the method of FIG. 18.

With reference to FIG. 20, the load profile is built by adding one point to the load profile at a time. As new load profile points 810 are added to the load profile, the load profile becomes larger and represents the mineral pile height along a greater length of the conveyor 115. FIG. 20 illustrates snapshots 840*a*-840*d* of the load profile as it is being built. In the first snapshot 840*a*, the load profile only extends across a short distance of the conveyor 115. With each consecutive snapshot 840*b*-840*d*, the load profile extends across a greater length of the conveyor 115.

The methods 500-800 explained above and illustrated in FIGS. 10-20 describe a method of determining a load profile that represents the amount of mineral on the conveyor 115 in terms of mineral pile height. However, the methods 500-800 explained above can be reconfigured to account for the weight or volume of the mineral on the conveyor 115 rather than the height of the mineral on the conveyor 115. In this embodiment, the height sensors would be replaced by weight sensors or other sensor capable of measuring weight and/or volume.

In addition, other conveyor characteristics can be focused on in place of a load profile. For example, in another embodiment, the controller 405 monitors the torque of the conveyor motor 120. The controller 405 may measure torque directly by using the motor sensor 447 (e.g., a torque sensor). Alternatively, the controller 405 can calculate the motor torque of the conveyor 115 based on other outputs received from the motor sensor 447 or additional sensors. For example, the controller 405 calculates the torque of the conveyor motor 120 based on the power input to the conveyor motor 120, the speed of the conveyor 115, or both, which may be detected using the motor sensor 447. In this case, sensors may be used to determine the power input and speed of the conveyor motor 120.

Referring to FIG. 9, regardless of which conveyor characteristic is monitored, the controller 405 determines a desired change in the conveyor characteristic (step 455) and adjusts the controllable components 420 to achieve the desired change in conveyor characteristic (step 460). A change in conveyor characteristic can be determined in a number of different manners. For example, the desired change in conveyor characteristic may be based on the difference between the current value of the conveyor characteristic and a predetermined set value or range. Adjusting the controllable components 420 may be carried out by the controller 405 executing one or more commands to adjust the speed of the conveyor 115, the haul speed of the shearer 110, the status of the snake delay, or a combination thereof. In some embodiments, the controller 405 executes a plurality of commands according to a command hierarchy. A command hierarchy includes two or more commands that are ranked relative to one another in order of preference. When a plurality of commands are executed according to a command hierarchy, the highest ranking command that is available is executed. Thus, the particular action taken when executing commands according to a command hierarchy depends on circumstances of the situation.

For example, in the case of a low level of material on the conveyor 115, a command hierarchy may rank a command to increase the haul speed of the shearer 110 higher than the command to lower the speed of the conveyor 115. According to this command hierarchy, the controller 405 would first send a command to the haulage motor 435 to adjust the haul speed of the shearer 110. The controller 405 continues to monitor the conveyor characteristic after each command is executed to recalculate the desired change in conveyor characteristic and determine whether the desired change has been achieved. If the desired change in conveyor characteristic is not achieved, the controller 405 may either execute the same command (in this case, increase the speed of the haulage motor 435), or may move on to a lower ranking command, such as reducing the speed of the conveyor 115. In some command hierarchies, the lower ranking commands may not be executed until the higher ranking commands are no longer available. A command may not be available if the speed of a motor is already at a maximum or minimum. For example, if the haulage motor 435 is at a maximum speed, a command to increase this speed is no longer available to the controller 405, and the controller 405 will move on to a lower ranking command. A command may also be unavailable if the action has already taken place. For example, if the conveyor 115 is not being advanced toward the coal face 303 by the roof supports 105 (i.e., the snake delay is on), the controller 405 cannot execute the command to initiate the snake delay as the snake delay has already initiated.

In some embodiments, the controller 405 may operate according to multiple hierarchies. For example a first hierarchy may be executed in situations where the conveyor characteristic being monitored is load profile, and a second hierarchy may be executed in situations where the conveyor characteristic being monitored is the torque of the conveyor 115 motor. Similarly, in other embodiments, the controller 405 may operate according to a first hierarchy when the desired change in conveyor characteristic is greater than zero (i.e., to increase the conveyor characteristic), and may operate according to a second hierarchy when the desired change in conveyor characteristic is less than zero (i.e., to decrease the conveyor characteristic). In another embodiment, different hierarchies may be used at different times of the day or year. For example, production goals may affect which hierarchy drives the operation of the controller 405.

Figure 21:
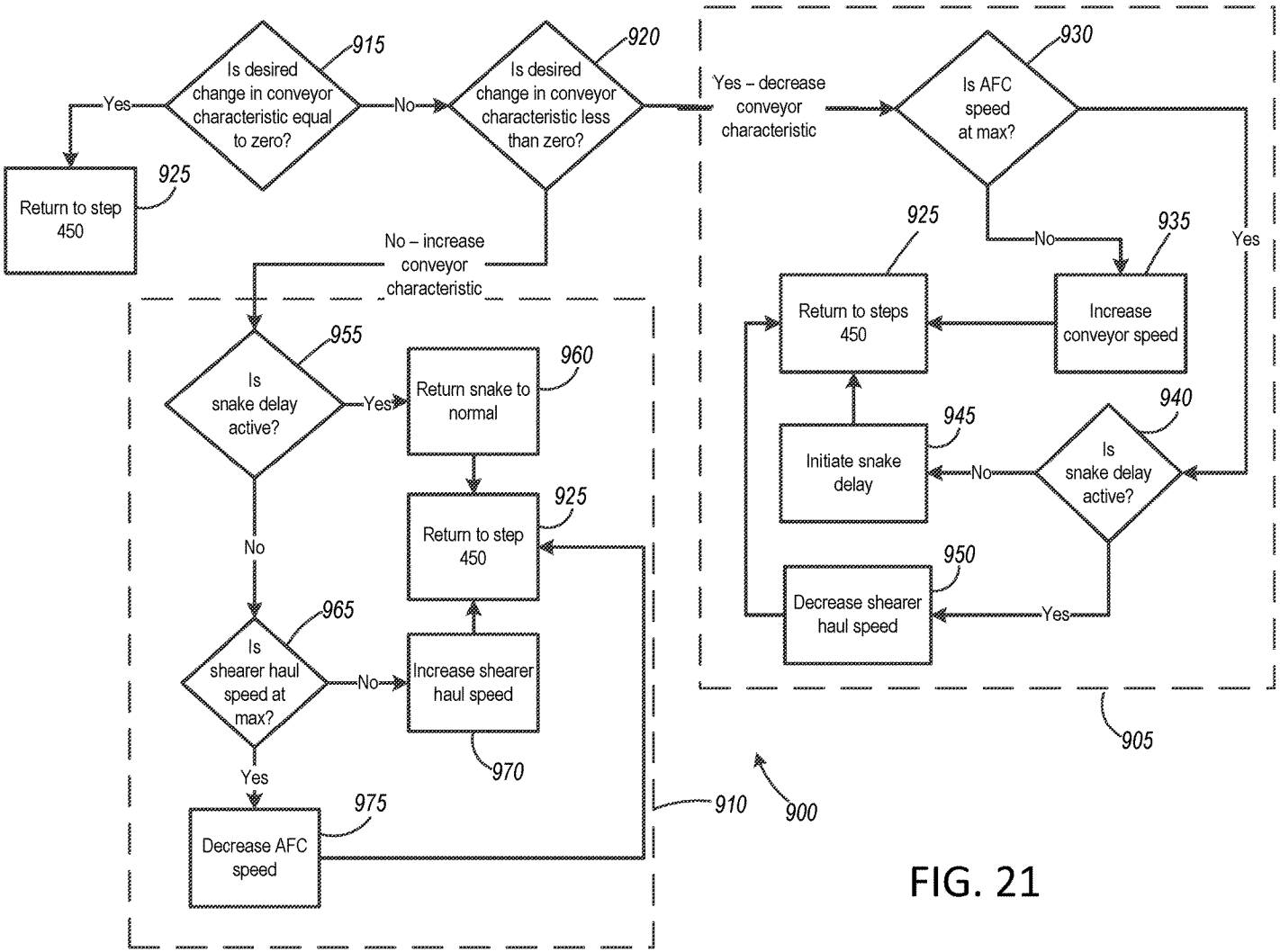
FIG. 21 is a flow chart illustrating a method of controlling a longwall mining system according to a hierarchy.

FIG. 21 illustrates a method 900 for adjusting the longwall mining system to achieve the desired change in conveyor characteristic using a command hierarchy. The method 900 may be carried out to implement step 460 of FIG. 9. In the embodiment of FIG. 21, the method 900 includes two command hierarchies 905, 910. When the desired change in conveyor characteristic is less than zero, the controller 405 adjusts the controllable components 420 according to a first hierarchy 905. When the desired change in conveyor characteristic is greater than zero, the controller 405 adjusts the controllable components 420 according to a second hierarchy 910. For example, if the conveyor characteristic being monitored is torque and the desired change in torque is less than zero, the controller 405 will decrease torque by adjusting the controllable components 420 according to the first hierarchy 905. If the desired change in torque is greater than zero, the controller 405 will increase the torque by adjusting the controllable components 420 according to the second hierarchy 910. When the desired change in conveyor characteristic is zero, the controller 405 does not execute a command. Rather, the controller 405 simply continues to monitor the conveyor characteristic (steps 450 and 455). The controller 405 will also monitor the conveyor characteristic between each command being executed (steps 450 and 455).

According to the embodiment shown FIG. 21. The controller 405 first determines whether the desired change in conveyor characteristic is equal to zero (step 915). If the desired change in conveyor characteristic is equal to zero (step 915), the controller 405 simply continues monitoring the conveyor characteristic and returns to step 450 (step 925). Then the controller determines whether the desired change in conveyor characteristic is greater than or less than zero (step 920). When the controller 405 determines that the desired change in conveyor characteristic is less than zero, the controller operates under the first hierarchy 905. The first hierarchy 905 ranks the command to increase the speed of the conveyor 115 higher than the command to adjust the status of the snake delay, and ranks the command to adjust the status of the snake delay higher than the command to decrease the speed of the haulage motor 435.

When the controller 405 determines that the desired change in conveyor characteristic is less than (and not equal to zero) (step 920), the controller 405 analyzes the speed of the conveyor 115 (step 930). If the conveyor 115 is not running at maximum speed, the controller 405 then executes a command to the conveyor motor 120 to increase the speed of the conveyor 115 (step 935). The controller 405 then returns via step 925 to steps 450 and 455 to update the conveyor characteristic and desired change values to determine whether the desired change in conveyor characteristic has been achieved. Upon returning to method 900, if the desired change in conveyor characteristic is still less than zero (steps 915 and 920), the controller 405 will return to step 930. In step 930, if the speed of the conveyor 115 is less than a maximum, the controller 405 will again increase the speed of the conveyor 115 (step 935). If the speed of the conveyor 115 is already at a maximum, this command is unavailable and the controller 405 will proceed to the next command in the hierarchy. In this embodiment, when the speed of the conveyor 115 is at a maximum (step 935), the controller 405 determines whether the snake delay is active (step 940). If the snake delay is not active, the controller 405 will send a signal to the power roof support motors 335 to initiate the snake delay (step 945). The controller 405 will then return to step 450 (via step 925) to obtain an updated conveyor characteristic value, then step 455 to obtain an updated desired change value, before returning to method 900 (via step 460). If the snake delay is already active, the controller 405 will send a command to the haulage motor 435 to decrease the speed of the haulage motor 435 (step 950).

When the controller determines that the desired change in conveyor characteristic is greater than zero (step 920), the controller 405 operates controllable components 420 of the longwall mining system 100 according to the second hierarchy 910. The second hierarchy 910 ranks the command to adjust the status of the snake delay higher than the command to increase the speed of the haulage motor 435, and ranks the command to increase the speed of the haulage motor 435 higher than the command to decrease the speed of the conveyor 115. This means that when the controller 405 determines that the desired change in conveyor characteristic is greater than zero (step 915), the controller analyzes the operation of the power roof supports 105 to determine whether the snake delay is active (step 955). When the snake delay is active, the controller 405 executes a command to control the advance ram 335 of the roof support 105 (via the roof support controller 425) to remove the snake delay and begins advancing the conveyor towards the coal face 303 as normal (step 960). If the snake delay is already inactive, this command is unavailable, so the controller 405 moves on to a lower ranking command. According to the second hierarchy 910, the next controllable component to be adjusted is the haulage speed of the shearer 110. The controller 405 analyzes the status of the haulage motor 435 (step 965). If the haulage motor 435 is not at a maximum speed, the controller 405 sends a command to the haulage motor 435 to increase the haul speed (step 970). If the haulage speed is at a maximum speed, the controller 405 sends a command to the conveyor motor 120 to decrease the speed of the conveyor 115 (step 975). After a command is executed (e.g., in steps 960, 970, or 975), the controller 405 returns to step 450 to obtain an updated value for the conveyor characteristic. If the desired change has not been achieved, on a subsequent pass through of method 900, the controller 405 either executes the same command, if it is available, or moves on to a lower ranking command.

As noted, the method 900 of FIG. 21 may be usual to effect step 460 of FIG. 9. With reference to FIG. 9, the controller 405 monitors the conveyor characteristic (steps 450 and 455) between each adjustment (step 460). Each time method 900 is executed, if the desired change in conveyor characteristic has not been achieved (i.e., the desired change is not equal to zero in step 915), the controller 405 then determines whether the desired change is greater than or less than zero (step 920), which indicates which hierarchy should be followed. Accordingly, the controller 405 continuously monitors and adjusts controllable components 420 of the longwall system according to a command hierarchy to optimize performance.

While FIG. 21 was described with respect to a torque of the conveyor 120 as the applicable conveyor characteristic, as noted previously, other conveyor characteristics may be used. For example, mineral height or weight on the conveyor 120 may be used to that end, an average height (or weight) of mineral on the conveyor 120 calculated from one of the generated load profiles (see, e.g. profile 521*e* of FIG. 21) may be used as the conveyor characteristic. The flow chart of FIG. 21 is for exemplary purposes only. FIG. 21 is an example of a two hierarchy system. However, the controller 405 can operate the longwall mining system 100 according to a greater or fewer number of hierarchies. In addition, the number and type of commands in the hierarchy can vary from hierarchy to hierarchy. Also, it should be apparent to one skilled in the art that commands sent from the controller 405 to a controllable component 420 can be send directly, or through additional controllers 425, 430, 440 specific to the controllable component 420.

Thus, the invention provides, among other things, systems and methods for controlling a longwall mining system 100. Various features and advantages of the invention are set forth in the following claims.

What is claimed is:

1. A method of controlling a longwall mining system, the longwall mining system including a longwall shearer, a conveyor, and a plurality of power roof supports, the method including:

creating, by a controller, a load profile of the conveyor representing a distribution of mineral along a length of the conveyor;

calculating, by the controller, a desired change in the load profile based on the load profile of the conveyor; and controlling, by the controller, the longwall mining system to adjust the distribution of mineral on the conveyor based on the desired change in load profile.

2. The method of claim 1, wherein controlling the longwall mining system to adjust the distribution of minerals on the conveyor includes at least one of altering the speed of the conveyor, altering a shearer haul speed of the shearer, initiating a snake delay, and removing the snake delay.

3. The method of claim 1, wherein creating a load profile includes:

calculating, by a processor, a pile height of mineral on the conveyor;

determining the speed of the conveyor, and creating the load profile based on the calculated pile height and the speed of the conveyor.

4. The method of claim 3, wherein creating a load profile further includes:

measuring, by an electronic sensing device, the pile height of mineral on the conveyor;

comparing the calculated pile height and the measured pile height to determine a correction factor;

applying the correction factor to the calculated pile height to create a corrected pile height; and creating the load profile based on the corrected pile height.

5. The method of claim 1, wherein creating a load profile includes:

measuring a pile height of mineral on the conveyor at a plurality of points along the conveyor;

determining a speed of the conveyor, and creating the load profile based on the measured pile height and the speed of the conveyor.

6. The method of claim 5, wherein measuring the pile height at a plurality of points along the conveyor includes measuring the pile height by a plurality of electronic measuring devices.

7. The method of claim 5, wherein measuring the pile height at a plurality of points along the conveyor includes measuring the pile height by an electronic measuring device that moves with the shearer.

8. A longwall mining system comprising:

a shearer;

a plurality of power roof supports;

a conveyor having a distribution of mineral along a length of the conveyor, the distribution of mineral represented by a load profile;

a plurality of motors for driving the shearer, the conveyor, and the power roof supports;

a controller configured to control the plurality of motors, wherein the controller controls the plurality of motors based on a desired change in the load profile.

9. The longwall mining system of claim 8, further including an electronic measuring device coupled to a power roof support, the electronic measuring device positioned closer to a maingate end than a tailgate end of the longwall mining system.

10. The longwall mining system of claim 8, further including a plurality of electronic measuring devices coupled to a plurality of roof supports.

11. The longwall mining system of claim 8, further including an electronic measuring device coupled to the shearer, the electronic measuring device movable with the shearer.

12. A method of controlling a longwall mining system, the longwall mining system having a plurality of controllable components including a longwall shearer, a conveyor, and a plurality of power roof supports, the method comprising:

determining, by a controller, a desired change in a conveyor characteristic;

controlling, by the controller, the controllable components of the longwall mining system to achieve the desired change in conveyor characteristic; and controlling the controllable components by executing a plurality of commands to adjust at least one of the controllable components, the plurality of commands executed according to a command hierarchy.

13. The method of claim 12, further including creating the command hierarchy by ranking of a list of available commands, the commands including at least one from the following list: adjusting the speed of the conveyor, adjusting a shearer haul speed, adjusting the status of a snake delay.

14. The method of claim 12, further including executing the plurality of commands according to a first command hierarchy when the desired change in conveyor characteristic is greater than zero, and executing the plurality of commands according to a second command hierarchy when the desired changed in conveyor characteristic is less than zero.

15. The method of claim 14, wherein the first command hierarchy ranks adjusting the shearer haul speed higher than adjusting the speed of the conveyor.

16. The method of claim 14, wherein the second command hierarchy ranks adjusting the status of the snake delay higher than adjusting the shearer haul speed.

17. The method of claim 12, wherein the conveyor characteristic is a load profile or motor torque.

18. A longwall mining system comprising:

a plurality of controllable components including a conveyor, a shearer, and a plurality of power roof supports;

a conveyor characteristic having a desired change in conveyor characteristic;

a controller electrically coupled to the controllable components, the controller configured to execute a plurality of commands to adjust the operation of at least one of the controllable components to achieve the desired change in conveyor characteristic; and a command hierarchy of commands, the controller configured to execute the plurality of commands according to the command hierarchy.

19. The longwall mining system of claim 18, wherein the command hierarchy represents a ranking of a list of available commands including at least one from the following list: adjusting the speed of the conveyor, adjusting a shearer haul speed, adjusting the status of a snake delay.

20. The longwall mining system of claim 18, wherein the plurality of commands is executed according to a first command hierarchy when the desired change in conveyor characteristic is greater than zero, and wherein the plurality of commands is executed according to a second command hierarchy when the desired changed in conveyor characteristic is less than zero.

21. The longwall mining system of claim 20, wherein the first command hierarchy ranks adjusting the shearer haul speed higher than adjusting the speed of the conveyor.

22. The longwall mining system of claim 20, wherein the second command hierarchy ranks adjusting the status of the snake delay higher than adjusting the shearer haul speed.

23. The longwall mining system of claim 18, wherein the conveyor characteristic is a load profile or motor torque.

* * * * *